US011224891B2

(12) United States Patent
Lutz et al.

(10) Patent No.: US 11,224,891 B2
(45) Date of Patent: Jan. 18, 2022

(54) POWDER CENTER FOR SUPPLYING A POWDER COATING FACILITY WITH COATING POWDER, AND METHOD FOR CLEANING OF THE POWDER CENTER

(71) Applicant: Wagner International AG, Altstatten (CH)

(72) Inventors: Gilbert Lutz, Kriessern (CH); Roman Schmid, Hinterforst (CH); Rene Schmid, Hinterforst (CH); Michael Dietsche, Kriessern (CH); Rolf Mazenauer, Widnau (CH); Michael Topp, Oberteuringen (DE); Patrik Studerus, Steinach (CH)

(73) Assignee: Wagner International AG, Altstatten (CH)

( * ) Notice: Subject to any disclaimer, the term of this patent is extended or adjusted under 35 U.S.C. 154(b) by 0 days.

(21) Appl. No.: 16/381,758

(22) Filed: Apr. 11, 2019

(65) Prior Publication Data

US 2019/0314848 A1 Oct. 17, 2019

(30) Foreign Application Priority Data

Apr. 12, 2018 (EP) ..... 18167062

(51) Int. Cl.
*B05B 14/10* (2018.01)
*B05B 5/16* (2006.01)
(Continued)

(52) U.S. Cl.
CPC ..... *B05B 14/10* (2018.02); *B05B 5/1683* (2013.01); *B05B 15/555* (2018.02); *B08B 5/02* (2013.01)

(58) Field of Classification Search
CPC ..... B05B 5/1683; B05B 7/1445; B05B 14/10; B05B 15/50; B05B 15/555; B05B 15/70; B08B 5/02
See application file for complete search history.

(56) References Cited

U.S. PATENT DOCUMENTS 4,823,731 A * 4/1989 Howeth ..... B05B 5/1683 118/326
8,166,908 B2 * 5/2012 Mauchle ..... B05B 7/1404 118/302
(Continued)

FOREIGN PATENT DOCUMENTS

DE 10 2005 060833 A1 6/2007
EP 2 218 514 A1 6/2010
JP 2001-259551 A 9/2001

OTHER PUBLICATIONS

Search Report for corresponding European Patent App. No. 18167062, dated Aug. 8, 2018.

*Primary Examiner* — Ryan A Reis
(74) *Attorney, Agent, or Firm* — Renner, Otto, Boisselle & Sklar, LLP

(57) ABSTRACT

A powder center for supplying a powder coating facility with coating powder includes a powder reservoir container and a powder conveyor for transporting powder out of the powder reservoir container in the direction of the powder coating facility. Moreover, the powder center includes a container lid that covers the powder reservoir container while powder is being conveyed and can be removed at least partly for the purpose of cleaning the powder reservoir container. Moreover, a cleaning unit for cleaning the powder reservoir container that can be moved from a parking position next to the powder reservoir container into a cleaning position inside the powder reservoir container by a manipulator is provided. Moreover, the powder center
(Continued)

includes a controller by which the powder conveyor, the cleaning unit, and the manipulator can be controlled.

19 Claims, 21 Drawing Sheets

(51) Int. Cl.
*B05B 15/555* (2018.01)
*B08B 5/02* (2006.01)

(56) References Cited

U.S. PATENT DOCUMENTS

| | | | | |
|---|---|---|---|---|
| 10,682,704 | B2 * | 6/2020 | Swanner, Jr. | B29C 64/20 |
| 2005/0115496 | A1 * | 6/2005 | Shutic | B05B 12/14 118/308 |
| 2007/0163493 | A1 * | 7/2007 | Lacchia | B05B 5/1683 118/300 |
| 2008/0257257 | A1 | 10/2008 | Mauchle | |
| 2010/0255975 | A1 | 10/2010 | Mauchle | |
| 2013/0019970 | A1 * | 1/2013 | Kleineidam | B05B 7/1472 137/565.01 |
| 2017/0267386 | A1 * | 9/2017 | Meleg | B08B 5/02 |

* cited by examiner

POWDER CENTER FOR SUPPLYING A POWDER COATING FACILITY WITH COATING POWDER, AND METHOD FOR CLEANING OF THE POWDER CENTER

This application claims priority under 35 USC § 119 to European patent application number 18167062.1, filed on Apr. 12, 2018, the entire disclosure of which is incorporated herein by reference.

TECHNICAL FIELD

The invention relates to a powder center for supplying a powder coating facility with coating powder, and a method for cleaning of the powder center.

DESCRIPTION OF RELATED ART

During the electrostatic coating of workpieces with coating powder, or powder for short, the powder is sprayed onto the workpiece to be coated by means of one or more powder applicators. Subsequently, the workpiece coated with powder is heated to melt the powder. Once the workpiece has cooled down, the powder forms a hard, closed cover layer on the workpiece.

During the coating process, the workpieces to be coated usually are situated in a powder coating booth, which shall hereinafter be referred to as booth or coating booth for short. The powder applicators are supplied with coating powder by means of a powder center.

If workpieces are to be coated with a different coating powder than the one used earlier, the coating process is interrupted and a so-called powder change takes place. During a powder change, i.e. when, for example, a different type of powder or powder of a different color is to be sprayed, more or less comprehensive cleaning measures are required in order to remove residues of the previously used powder from the powder center, the powder hoses, the powder applicators, the booth, and other powder-conducting components of the facility. Manual cleaning can take considerable time to accomplish. During the cleaning process, the facility is not available for the coating of workpieces. This has a negative effect on the production costs. It is another disadvantage of manual cleaning that the staff runs the risk of inhaling powder particles during the cleaning process. Moreover, it must be made sure that the cleaning is done thoroughly. If, for example, the powder center is not cleaned sufficiently, there may be an undesirable carry-over of color after a color change.

A coating powder supplying device is known from printed specification EP 2 218 514 A1. The supplying device comprises a powder reservoir container with a lid, a suction tube, and multiple powder conveyors for conveying powder out of the powder reservoir container. The powder reservoir container can be moved together with the suction tube vertically up and down. The powder conveyors, in contrast, are arranged such as to be stationary and project into the powder reservoir container from above through openings in the suction tube and in the lid of the powder reservoir container. Once the suction is being activated and the powder reservoir container travels together with the suction tube along the powder conveyors, the powder conveyors are cleaned automatically. The powder reservoir container and its lid are not being cleaned automatically though, but must be cleaned manually.

SUMMARY OF THE INVENTION

It is an object of the invention to devise a powder center for supplying a powder coating facility with coating powder and a method for cleaning of the powder center, in which the cleaning of the powder center can take place fully automatically.

Advantageously, the powder center is being cleaned extraordinarily well.

The automatic cleaning can comprise single or multiple components of the powder center, such as the powder container, the lid of the powder container, the powder conveyor or conveyors and/or the ultrasound screen.

The object is met by a powder center for supplying a powder coating facility with coating powder having the features described herein.

The powder center according to the invention for supplying a powder coating facility with coating powder comprises a powder reservoir container and a powder conveyor for transporting powder out of the powder reservoir container in the direction of the powder coating facility.

Moreover, the powder center comprises a container lid that covers the powder reservoir container while powder is being conveyed and can be removed fully or partly for the purpose of cleaning the powder reservoir container. Moreover, the invention provides a cleaning unit for cleaning of the powder reservoir container that can be moved from a parking position next to the powder reservoir container into a cleaning position inside the powder reservoir container by means of a manipulator. Moreover, the powder center comprises a controller by means of which the powder conveyor, the cleaning unit, and the manipulator can be controlled.

The object is also met by a method for cleaning of the powder center having the features described herein. The cleaning unit is used to clean the powder reservoir container and the container lid. In a further step, a switch to a different coating powder or a cleaning agent is made. In an additional step, a switch into conveying mode is made for a limited period of time. Subsequently, the powder reservoir container and the container lid are cleaned again by means of the cleaning unit.

Advantageous developments of the invention are evident from the features described herein.

In one embodiment of the powder center according to the invention, the cleaning unit comprises compressed air nozzles for blowing off the powder reservoir container and the lid. This allows the powder reservoir container and the lid to be cleaned in an energy efficient manner.

In another embodiment of the powder center according to the invention, a portion of the compressed air nozzles is arranged on a first cleaning arm and another portion of the compressed air nozzles is arranged on a second cleaning arm. The first cleaning arm is used for cleaning the lid and the second cleaning arm is used for cleaning the powder reservoir container.

In an additional embodiment of the powder center according to the invention, the first cleaning arm and the second cleaning arm are supported such that they can be rotated.

In a development of the powder center according to the invention, the first cleaning arm comprises a brush and/or a suction facility. Instead or additionally, the second cleaning arm can also comprise a brush and/or a suction facility.

In another development of the powder center according to the invention, the cleaning unit comprises a cleaning container that bears the first cleaning arm and/or the second cleaning arm. In cleaning mode, the cleaning arm can be positioned inside the powder reservoir container.

In an additional development of the powder center according to the invention, the manipulator comprises a linear axle for moving the cleaning unit.

In the powder center according to the invention, the manipulator can be a robot.

Advantageously, the powder center according to the invention is provided with multiple powder conveyors and a coupling with a first group of connectors and a second group of connectors. The controller can be used to adjust which connector of the first group is connected to which connector of the second group. The powder conveyors are each connected, on the output side, to one of the connectors of the first group.

The powder center according to the invention, can have a powder conveyor, by means of which the coating powder can be conveyed into the powder reservoir container, be arranged above the container lid.

An embodiment of the powder center according to the invention provides a powder outlet for residual powder and a further powder conveyor in the base of the powder reservoir container. The further powder conveyor can be used to suction the residual powder through the powder outlet out of the powder reservoir container and to feed it to a powder container.

Another embodiment of the powder center according to the invention provides a further manipulator to be able to take the container lid off the powder reservoir container.

In an additional embodiment of the powder center according to the invention, the cleaning unit comprises a container lid cleaning device for cleaning of the container lid, whereby the container lid cleaning device bears the first cleaning arm.

Advantageously, the powder reservoir container of the powder center according to the invention has a circular cross-section.

The powder center according to the invention can comprise a screen or a screen cleaning device for cleaning of the screen. For cleaning purposes, the screen can be moved, by means of an additional manipulator, from a working position inside the powder reservoir container into a cleaning position inside the screen cleaning device.

In the powder center according to the invention, the screen cleaning device can comprise an upper cleaning arm with compressed air nozzles and a lower cleaning arm with compressed air nozzles. The screen is situated between the upper cleaning arm and the lower cleaning arm during the cleaning process.

In a development of the powder center according to the invention, the screen cleaning device comprises a cleaning container with a lid that can be opened. The upper cleaning arm is supported on the lid such that it can rotate, and the lower cleaning arm is supported on the cleaning container such that it can rotate.

An additional development of the powder center according to the invention provides a suction system for aspiration of the powder-air mixture generated by the cleaning unit.

BRIEF DESCRIPTION OF THE DRAWINGS

The invention and several exemplary embodiments are illustrated in more detail in the following based on 23 figures.

DETAILED DESCRIPTION OF THE INVENTION

Figure 1:
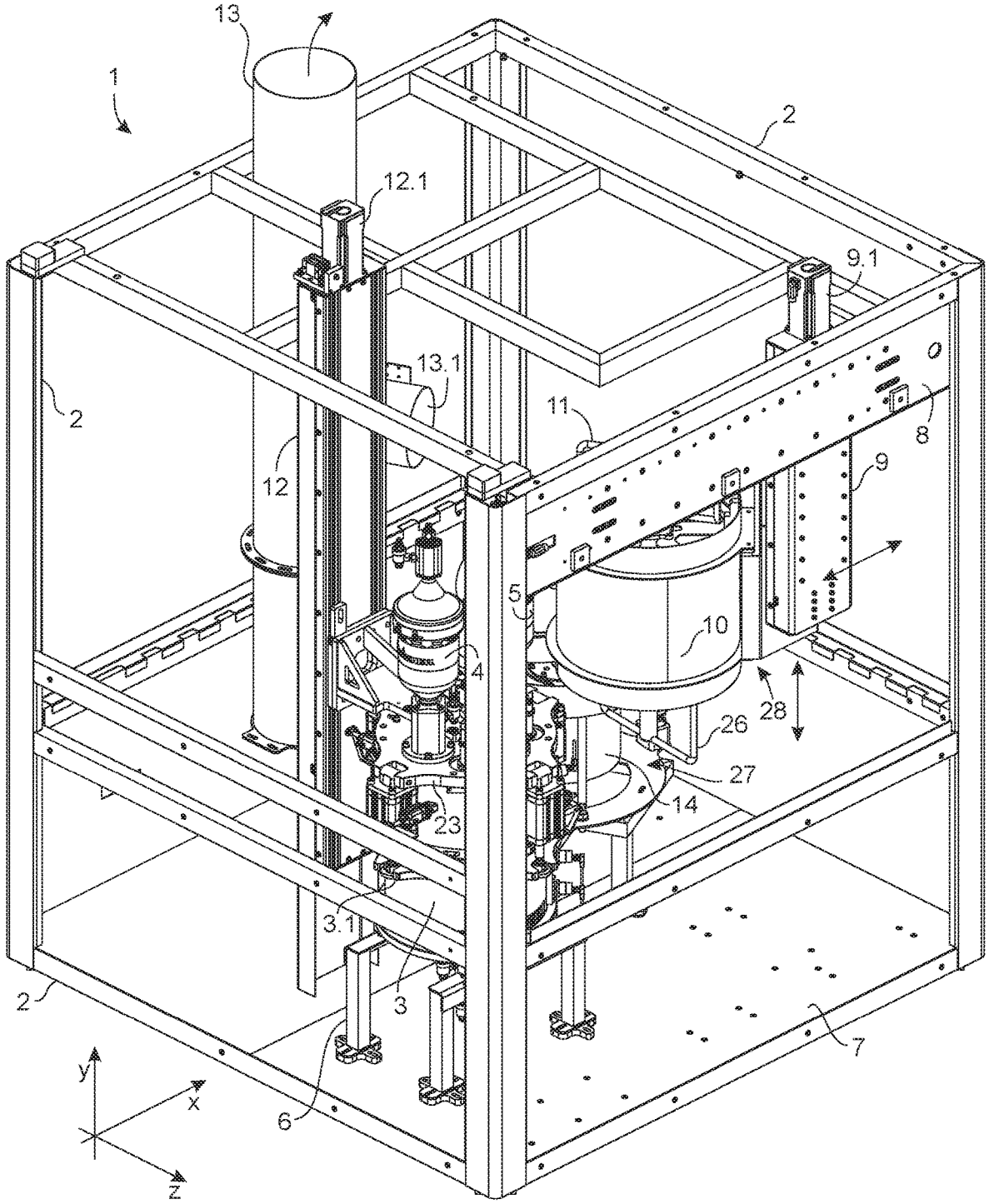
FIG. 1 shows a first three-dimensional view of a first possible embodiment of the powder center according to the invention in powder conveying mode.
Figure 2:
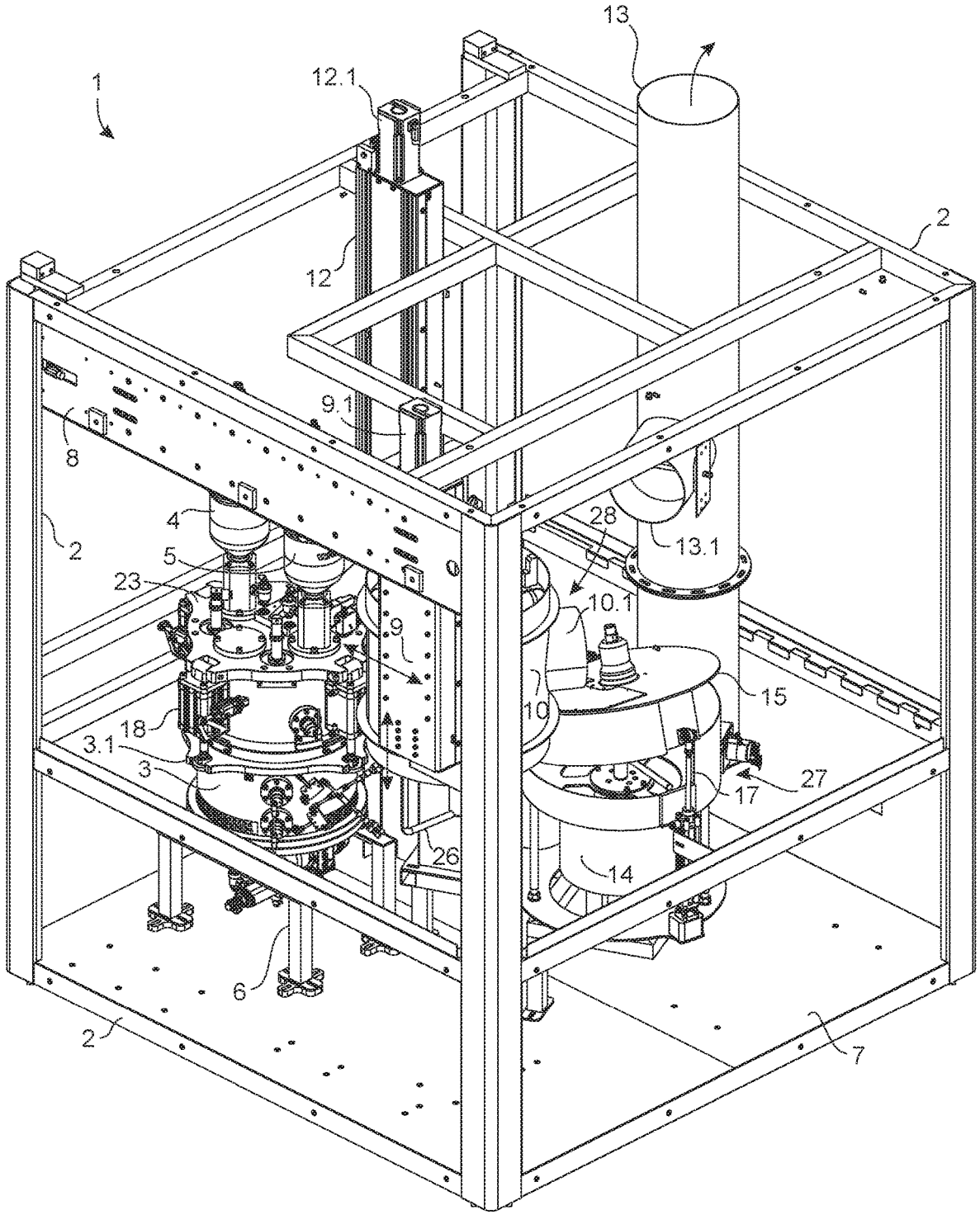
FIG. 2 shows a second three-dimensional view of the first embodiment of the powder center according to the invention.
Figure 3:
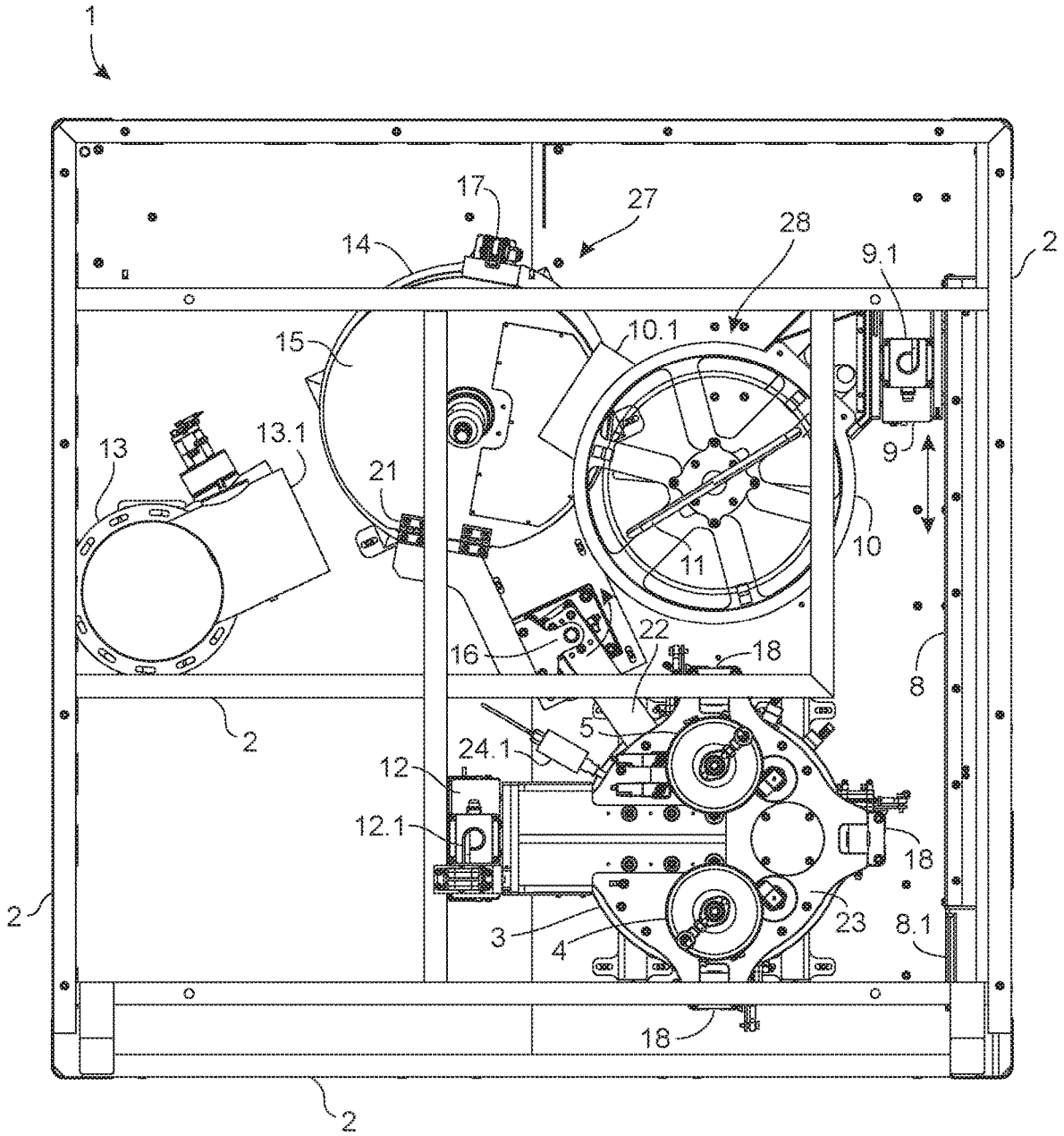
FIG. 3 shows a top view of the first embodiment of the powder center according to the invention.
Figure 4:
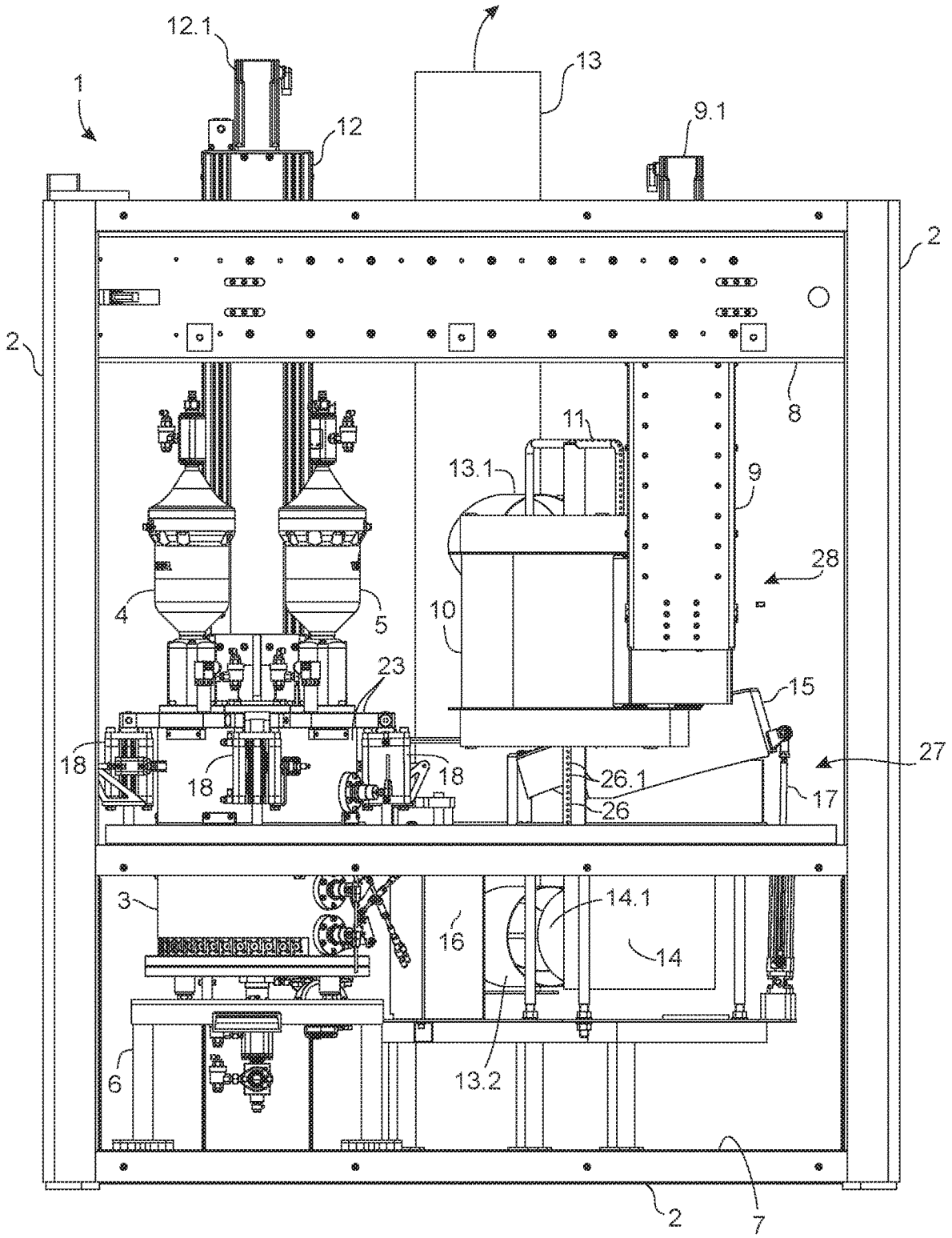
FIG. 4 shows a first side view of the first embodiment of the powder center according to the invention.

The layout of the entire powder coating facility is illustrated in more detail in the following based on FIGS. 1 to 15.

The powder center 1, also referred to as powder supplying device, powder center or integrated powder management system, comprises a powder reservoir container 3 that is used for storing the coating powder. Moreover, the powder center 1 comprises a powder conveying device by means of which the powder is conveyed out of the powder reservoir container 3 and is transported to a powder applicator 80. The powder conveying device is integrated into the powder reservoir container 3 in the present case and shall be illustrated in more detail later on. The powder applicator 80

(see FIG. 14) can be designed as a manual or automatic powder spraying device and comprises, on its outlet facing the workpiece 65, a spray nozzle or a rotation atomizer.

The powder center 1 is designed as a module. By this means, the powder center 1 can be transported rapidly and easily as a compact unit. The individual components of the powder center 1 are attached to frame profiles 2 that can be made of aluminum or steel, for example. The frame profiles 2 form the outer boundary of the powder center 1. In case of need, the powder center 1 can comprise a base 7.

Figure 6:
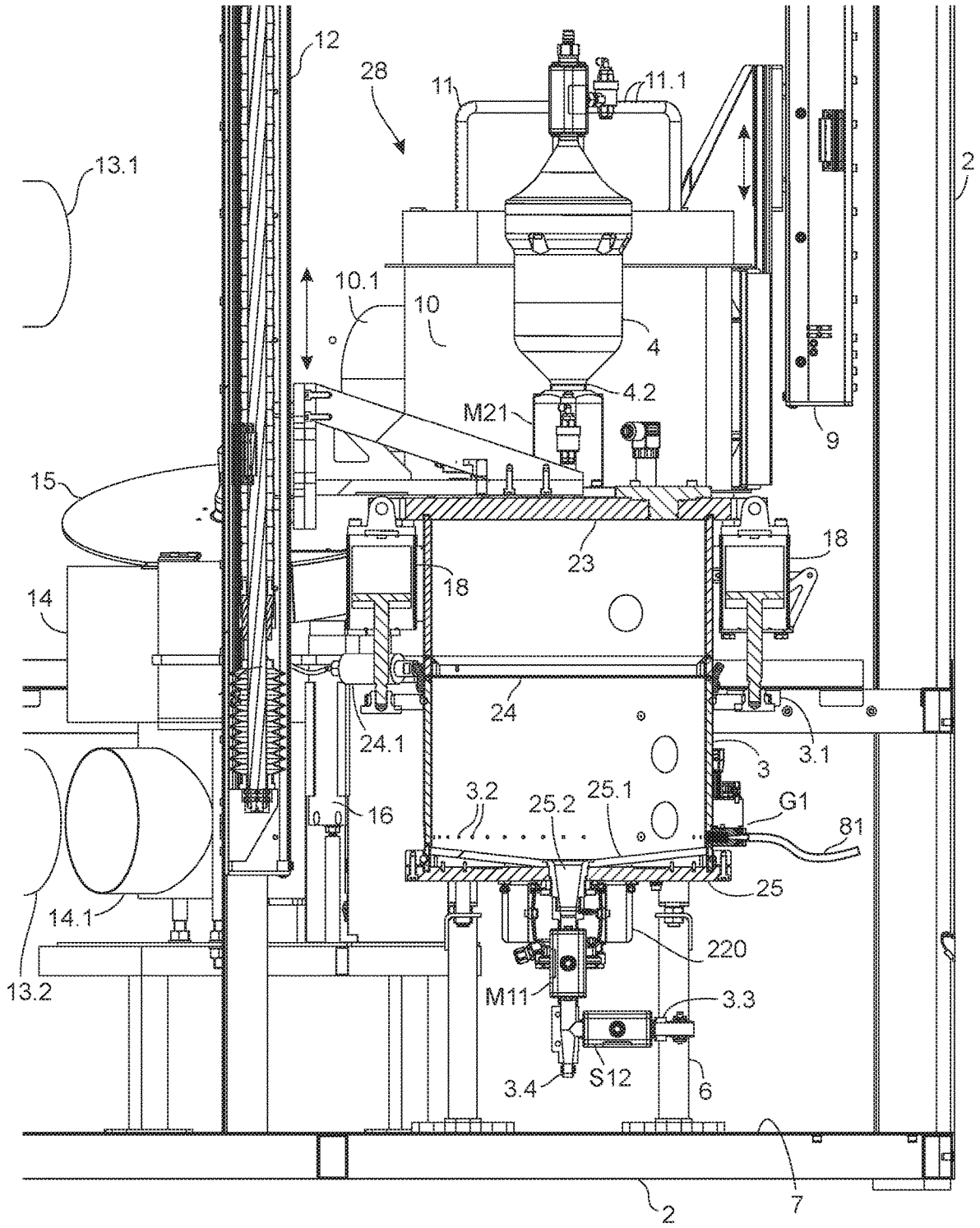
FIG. 6 shows a magnified view, from the side, of another part of the first embodiment of the powder center according to the invention.

The powder reservoir container 3 of the powder center 1 can be arranged, for example, on a pedestal 6. As shown in FIG. 6, the powder reservoir container 3 can be closed off by a powder container lid 23 during conveying mode. In the embodiment shown in FIG. 6, the powder container lid 23 takes the shape of an inverted pot. By means of pneumatic locks 18, the powder container lid 23 can be closed off tightly against the powder reservoir container 3. For this purpose, the powder reservoir container 3 comprises seals and lock receptacles 3.1 that can be engaged by appropriately designed counterparts of the pneumatic lock 18. The pneumatic lock 18 can be fitted, for example, with a cylinder, a piston, and a piston rod. When compressed air is being applied to the lower chamber of the cylinder, the piston and thus the piston rod are pushed upwards. The grab situated on the lower end of the piston rod engages the lock receptacle 3.1 and causes the powder container lid 23 to be pushed onto the powder reservoir container 3. Three such locks 18 are present in the embodiment shown in FIG. 6. The number of locks 18 as well as their design can be readily adapted to the respective needs.

A screen 24, which can be designed as an ultrasound screen, is situated on the inside of the powder reservoir container 3. The ultrasound transducer 24.1 of the screen 24 is preferably situated outside the powder reservoir container 3. The screen 24 is accessible and can be taken out once the powder container lid 23 is taken off. For this to take place automatically, the ultrasound screen 24 is attached to a pivoting mechanism 16 by means of a support arm 22. Using the pivoting mechanism 16, the screen 24 can be pivoted out of the working position (see FIG. 3) and can be moved into a cleaning position in a cleaning station 27 (see FIG. 9). The cleaning station 27 shall also be referred to as screen cleaning station hereinafter.

Figure 5:
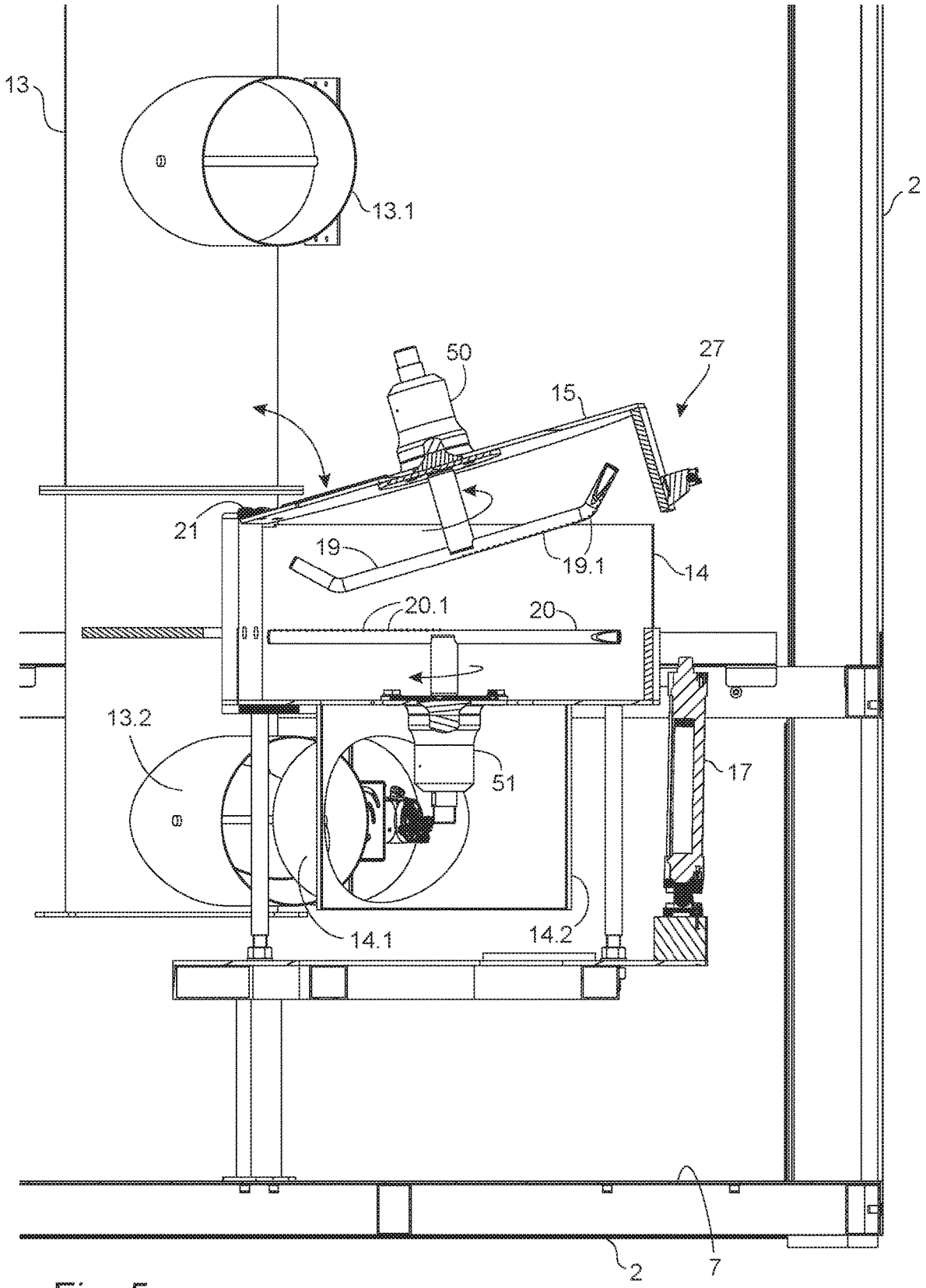
FIG. 5 shows a magnified view, from the side, of a part of the first embodiment of the powder center according to the invention.

As shown in FIG. 5, a cleaning arm 20, which is supported such that it can rotate, is situated on the inside of the cleaning station 27. The cleaning arm 20 comprises a multitude of cleaning nozzles 20.1, which are arranged on the top side of the cleaning arm 20. The cleaning station 27 also comprises a lid 15 that can be opened and closed, for example, by means of a pneumatic cylinder 17.

The lid 15 is pivoted about a hinge 21 in this context. A curved double arrow indicates the pivoting motion. The lid 15 bears, on its underside, a cleaning arm 19, which is also fitted with a multitude of cleaning nozzles 19.1. The cleaning nozzles 19.1 are preferably situated on the underside of the cleaning arm 19. They are aligned appropriately such that they blow compressed air downwards onto the ultrasound screen 24, which is situated below the cleaning arm 19, during cleaning mode. The upper cleaning arm 19 is supported, such that it can rotate, on the lid 15 by a bearing 50. The lower cleaning arm 20 is supported, such that it can rotate, on the cleaning container 14 by a bearing 51. The two bearings 50 and 51 can just as well be designed in the form of air motors. The direction of rotation of the upper cleaning arm 19 and the direction of rotation of the lower cleaning arm 20 are each indicated by an arrow. During cleaning mode, the ultrasound screen 24 is situated between the lower cleaning arm 20 and the upper cleaning arm 19.

The cleaning arm 19 can be angled on both ends (as shown in FIG. 5) such that it has a horizontal leg and two legs that are slanting upwards. The compressed air nozzles 19.1 can just as well be situated on the horizontal leg and on the legs slanting upwards. The cleaning arm 19 can be designed in the form of a tube for guiding the compressed air on the inside of the tube to the compressed air nozzles 19.1. The same applies analogously to the lower cleaning arm 20, even though the ends of the lower cleaning arm 20 are not angled in FIG. 5.

A lower container section 14.2 with an outlet 14.1 for accommodating the screen 24 is situated on the underside of the container 14. The outlet 14.1 can be used to aspirate the powder-air mixture that is present in the cleaning station 27. For this purpose, the outlet 14.1 is connected to an inlet opening 13.2 of a suction tube 13 by means of a hose that is not shown in the figures. The powder-air mixture can be suctioned via the suction tube 13 and a suction line 91 into an after-filter 100.

The powder reservoir container 3 and its powder container lid 23 shall also be referred to as working container 3, 23 hereinafter. The powder inlet 23.1 of the working container 3, 23 is preferably situated in the upper part thereof. For example, it can be arranged in the powder container lid 23 of the working container 3, 23. The working container 3, 23 can, in addition, comprise further powder inlets for this purpose. The powder inlet 23.1 is connected to the powder outlet 4.2 of an intermediate container 4 by means of a powder valve M21, which can be designed, for example, in the form of a pneumatically controlled crusher. The intermediate container 4 serves as powder conveyor and is usually arranged above the working container 3, 23. By this means, gravity can be used to transport powder that is situated in the intermediate container 4 downwards into the working container 3, 23.

A second powder conveyor 5 can be arranged above the working container 3, 23. The powder outlet thereof also merges into the working container 3, 23.

The powder conveying device that is integrated into the powder reservoir container 3 shall be illustrated in more detail in the following. The powder conveying device can be designed in the way described in European patent application EP 3 238 832 A1. The working container 3, 23 is designed and can be operated appropriately such that pressure can be applied to it. Powder can be conveyed out of the fresh powder station 30 and can be transported into the working container 3, 23 by means of the powder conveyor 4. A corresponding powder inlet is present in the powder container lid 23 that covers the powder reservoir container 3 on the top. The working container 3, 23 comprises, in the area of the container base 25, a fluidizing insert 25.1 for fluidizing the powder, and a series of powder outlets 3.2. The invention can provide one powder outlet valve G1-G36 to be connected to each of the powder outlets 3.2. In turn, one powder line 81 each is connected to each of the powder outlet valves G1-G36.

Moreover, each of the powder lines 81 comprises an inlet for transport air on the inlet side, i.e. in the proximity of the corresponding powder outlet valve G1-G36. On the outlet side, each of the powder lines 81 is preferably connected to one of the powder applicators 80 each by means of a coupling 130. The amount of powder to be conveyed is controlled by repeatedly opening and closing the corresponding powder outlet valve G1-G36 by means of a controller 70. To avoid repetitions, reference shall be made to the aforementioned patent application EP 3 238 832 A1, the content of which shall herewith be made a part of the present application.

An embodiment of the working container 3, 23 provides a vibrator 220 that can be situated, for example, below the powder reservoir container 3 (see FIG. 6). The shaking motions generated by the vibrator 220 can be used to fluidize the powder-air mixture in the powder reservoir container 3 even more homogeneously. Moreover, by this means, the powder-air mixture can flow even more optimally out of the powder outlet channel 203.

For this purpose, the coupling 130 comprises a first group of connectors 131 and a second group of connectors 132. The controller 70 can be used to adjust which connector of the first group 131 is connected to which connector of the second group 132. Accordingly, each individual powder line 81 can be connected, on the outlet side, to one connector of the first group 131 each. Each individual powder line can be connected to a connector of the second group 132 each, and can be connected, on the other side, to one of the powder applicators 80 each.

In one embodiment, 36 powder outlet valves G1-G36 are used. However, more or fewer powder outlet valves can be used just as well. The number of powder outlet valves that is used depends on the number of powder applicators 80 that are used.

As an alternative to the integrated powder conveying device with the power outlet valve G1 just described, the invention can just as well provide a powder injector that works according to the Venturi principle or a powder pump for dense phase conveying.

Instead of the powder conveyor 4, a powder pump for dense phase conveying, a hose pump or a powder injector can just as well be provided. The same shall apply to the powder conveyor 5 analogously.

A powder outlet 25.2 that is connected to the outlet 3.3 of the reservoir container 3 by means of a valve M11 is situated in the base 25 of the powder reservoir container 3. By means of the outlet 3.3, residual powder that is still present in the powder reservoir container 3 can be transported back to the fresh powder station 3 with the aid of a powder conveyor 49. For this purpose, the powder conveyor 49 can be connected to the outlet 3.3 of the reservoir container 3 by means of a hose that is not shown in the figures.

The powder reservoir container 3 and the powder container lid 23 thereof as well as the two powder conveyors 4 and 5 are attached to a vertical linear axle 12, which is also referred to as linear lifting device, and can be moved up and down by this device. The drive 12.1 of the linear axle 12 can be situated on the top of the linear axle 12. The direction of motion thereof is indicated by the vertical double arrow in FIG. 6.

In addition, the powder center 1 comprises a container cleaning unit 28, or cleaning unit for short, that comprises a cleaning container 10, an upper cleaning arm 11, and a lower cleaning arm 26. The upper cleaning arm 11 and the lower cleaning arm 26 are supported in the cleaning container 10 such that they can rotate and each comprise a multitude of compressed air-operated cleaning nozzles 11.1 or 26.1. The cleaning container 10 is attached to a linear lifting device 9 and can be moved vertically upwards and downwards (in y direction) by the device. The direction of motion thereof is indicated by the vertical double arrow in FIG. 1. The drive 9.1 of the linear lifting device 9 can be situated on the top of the linear lifting device 9. The linear lifting device 9, in turn, is attached to a horizontally-aligned linear drive (also referred to as linear axle) and can be moved horizontally (in x direction) back and forth by same. The drive 8.1 of the linear axle 8 can be situated on the side of the linear axle 8. It is possible, by means of the linear axle 8, to position the container cleaning unit 28 laterally next to the working container 3, 23 (see FIGS. 1 to 4) during conveying mode. During cleaning mode, the container lid 23 is driven upwards first; then the container cleaning unit 28 can be positioned appropriately by means of the two linear drives 8 and 9 such that the cleaning container 10 is first moved over the powder reservoir container 3 and is then lowered to the extent such that the cleaning arm 26 is situated at a defined distance from the base 25 of the powder reservoir container 3. The cleaning arm 26 projecting on the bottom from the cleaning container 10 is then situated inside the powder reservoir container 3 and serves for cleaning the inner wall and the base 25 of the powder reservoir container 3.

The linear lifting device 12 can then be used to lower the powder container lid 23 to the extent such that the cleaning arm 11 that projects on the top from the cleaning container 10 can be used to blow off, and thus clean, the inner surfaces of the powder container lid 23. The cleaning arm 11 projects into the inside of the powder container lid 23 in this context.

One possible embodiment of the fresh powder station 30 is shown in various views in FIGS. 10 to 13.

Figure 12:
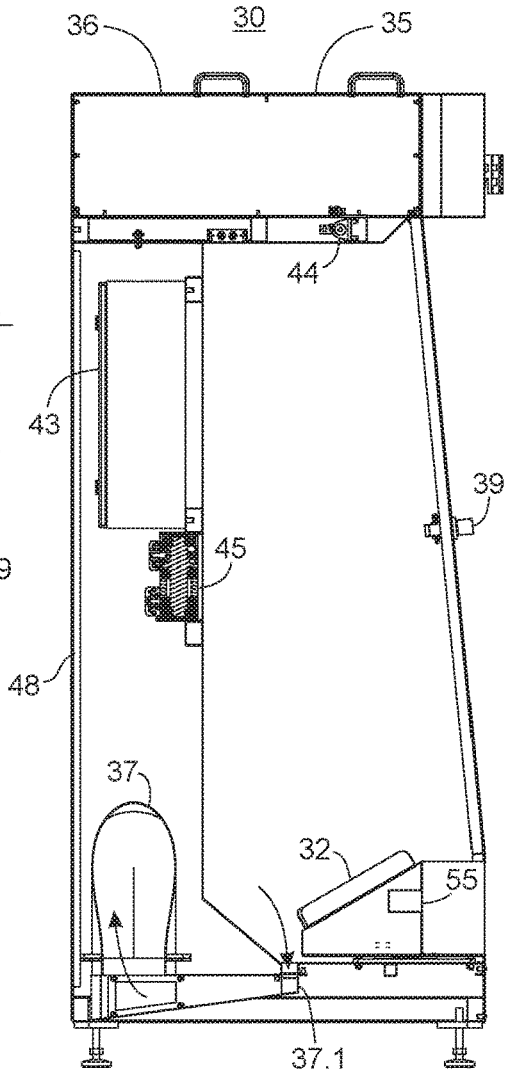
FIG. 12 shows a sectioned side view of the fresh powder station.
Figure 13:
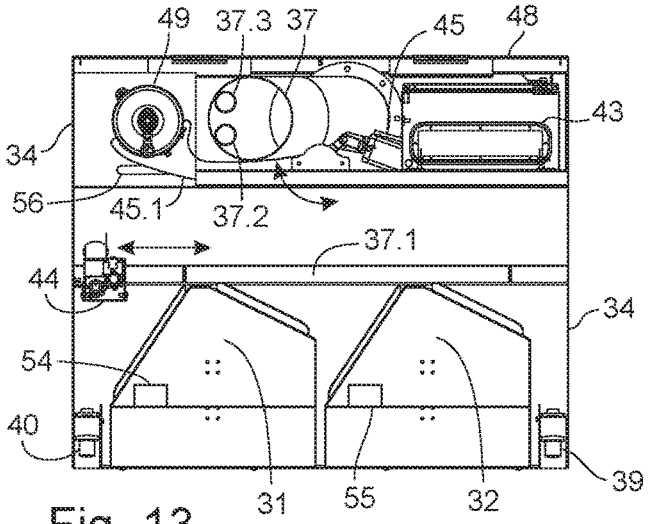
FIG. 13 shows a sectioned top view of the fresh powder station.

The fresh powder station 30 can be designed, for example, as an independent module. It comprises a first storage space 31 and a second storage space 32, which each can accommodate a powder carton 110, 111 (see FIG. 15). The two storage spaces 31 and 32 are preferably arranged such as to be slanted such that the powder migrates obliquely downwards into a corner in the powder carton supported by gravity. By this means, the powder carton can be readily emptied by means of a suction lance 33 without any residue or hardly any residue being left behind. As shown in FIGS. 12 and 13, the suction lance 33 can be moved horizontally by means of a linear drive 44 such that it can be used for both a powder carton that is arranged on the first storage space 31 as well as for a powder carton that is arranged on the second storage space 32. Moreover, the fresh powder station 30 comprises an additional linear drive 38 to be able to move the suction lance 33 vertically as well.

A vibrator 54 and a scale 46 are situated below the storage space 31 for the powder carton 110. The purpose of the vibrator 54 is to agitate the powder in the carton 110 such that it is distributed better and flows in the direction of the suction lance 33.

The scale 46 can be used to determine the filling level in the carton 110, and to initiate a change of powder cartons once the filling level drops below a certain level. Moreover, the measuring signal generated by the scale 46 can be used to recognize if there is still sufficient space in the carton 110 when powder is to be conveyed via the line 96 from the powder center 1 back to the powder station 30.

Likewise, a vibrator 55 and a scale 47 are situated below the storage space 32. Their purpose is analogous to that of the vibrator 54 and of the scale 46 in the case of storage space 31.

To be able to clean the suction lance 33, the fresh powder station 30 comprises, in addition, a cleaning station 52 that is equipped with a wiper ring and/or compressed air nozzles and/or a suction system. By this means, powder adhering to the outside of the suction lance 33 can be removed during the up and down motion.

In addition, air nozzles 57 can be provided on the cleaning station 53 for cleaning of the lower area of the suction lance 33. If the suction lance comprises a fluidizing crown for fluidizing the powder in the suction area, same can be cleaned with this as well.

Instead of two storage spaces 31 and 32 with two powder cartons 110 and 111, just one storage space 32 and a powder container 150 with a fluidizing facility could be installed just as well. For example, two pumps 124 and 125 could be used to convey powder from a Big Bag 121 into the powder container 150.

Instead of or in addition to the Big Bag 121, a Big Bag 120 with a pump 123 could be provided just as well. The powder can be pumped via a powder line 126 directly to the powder conveyor 4 by a pump 123.

The Big Bag 120 or 121 is also referred to as Flexible Intermediate Bulk Container or FIBC, for short. It usually contains larger amounts of powder than the powder carton 110 and the powder carton 111. Moreover, the Big Bag 120/120 usually stands farther away from the powder conveyor 4 than the powder carton 110 or 111. Accordingly, the Big Bag 120/121 can stand at a distance of, for example, 30 m from the powder conveyor 4, whereas the powder carton 110 or 111 stands, for example, at a distance of 5 m from the powder conveyor 4.

The fresh powder station 30 can comprise multiple compressed air regulating valves 39 and 40 and adjusting knobs 41 and 42. The compressed air regulating valve 39 can be designed for adjusting the fluid air of the fluid base of the powder container 150. The purpose of the compressed air regulating valve 40 is to adjust the fluid air at the fluidizing crown of the suction lance 33. The adjusting knob 41 can be used to control the position of the exhaust air damper. The adjusting knob 42 can be used to transmit a confirmation signal to the controller.

The fresh powder station 30 can comprise, in its base area, a suction system 37 with a suction opening 37.1 to be able to aspirate excess powder out of the inside of the fresh powder station 30. The fresh powder station 30 can also comprise a flexible suction hose that can be used for manual cleaning in case of need.

The invention can provide the fresh powder station 30 to comprise a pivoting mechanism 45 for the powder conveyor 49. The pivoting mechanism 45 comprises a drive, which can, for example, be designed as a pneumatic drive, and a pivoting arm 45.1. The pivoting mechanism 45 can be used to transition the powder conveyor 49 out of the conveying position (see FIG. 10) into a cleaning position. In the cleaning position, the powder conveyor 49 projects into the interior space of the fresh powder station 30. In addition, air nozzles 56 can be provided for cleaning of the lower area of the powder conveyor 49 when it is being pivoted out of the conveying position into the cleaning position or out of the cleaning position into the conveying position.

The pneumatic drive can comprise two pneumatically driven cylinders. By this means, the powder conveyor 49 can be transitioned into a cleaning position, a first conveying position, and a second conveying position. To transition the powder conveyor 49 into the cleaning position (see FIG. 10), the cylinder 1 and the cylinder 2 are being retracted. In the first conveying position, the powder conveyor 49 is situated above the storage space 31. For this purpose, the cylinder 1 is being retracted and cylinder 2 is being driven out. In the second conveying position, the powder conveyor 49 is situated above the storage space 32; the cylinders 1 and 2 are driven out. In the first conveying position, powder can be conveyed back into the powder carton 110, and, in the second conveying position, powder can be conveyed back into powder carton 111.

The suction lance 33 can be transitioned into three different positions by the linear axle 38 and the linear drive 44: In the cleaning position (see FIG. 10), the suction lance 33 is situated in the cleaning station 53. In the first conveying position, the suction lance 33 is situated above the storage space 31 and, in the second conveying position, it is situated above the storage space 32.

In case of need, the fresh powder station 30 can just as well be equipped with its own controller 43. For example the suction lance 33, the cleaning station 52 for the suction lance 33, the linear axle 38, the linear drive 44, the pivoting mechanism 45, and the blow nozzles 56 and 57 can be controlled by said controller 43.

Figure 11:
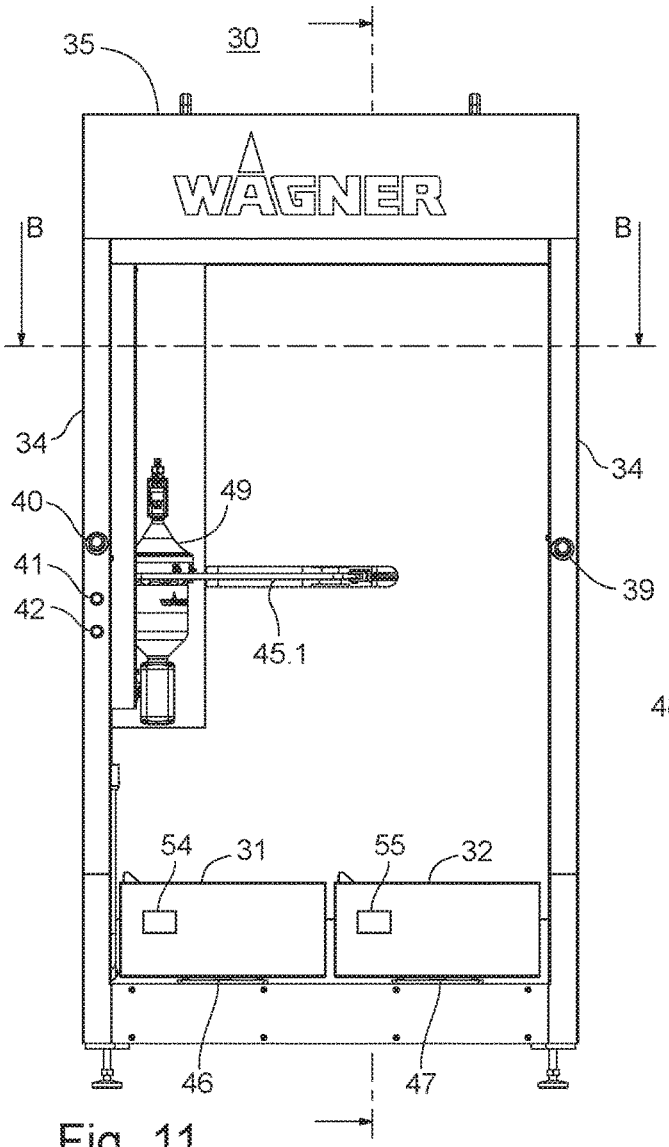
FIG. 11 shows a frontal view of the fresh powder station.

The powder conveyor 49 shown in FIGS. 11 and 13 is advantageously being positioned directly above the powder carton 110 or 111 into which it is to convey powder. Since it utilizes gravity, the powder drops into the powder carton situated below the powder conveyor 49 once the outlet valve of the powder conveyor 49 is opened.

The powder conveyor 49 for recycling the powder shown in FIGS. 11 and 13 can just as well be designed differently. For example, it can be designed as a powder pump. Since a powder pump of this type does not utilize gravity, it can be arranged in different places. For example, it can be situated at the same height level as the powder carton 110.

Two doors 35 and 36 that can be opened manually can be provided on the topside of the powder station 30. By this means, the staff also has access from above to the inside of the fresh powder station 30.

In case of need, the fresh powder station 30 can just as well be equipped with side walls 34 and a rear wall 48.

Figure 14:
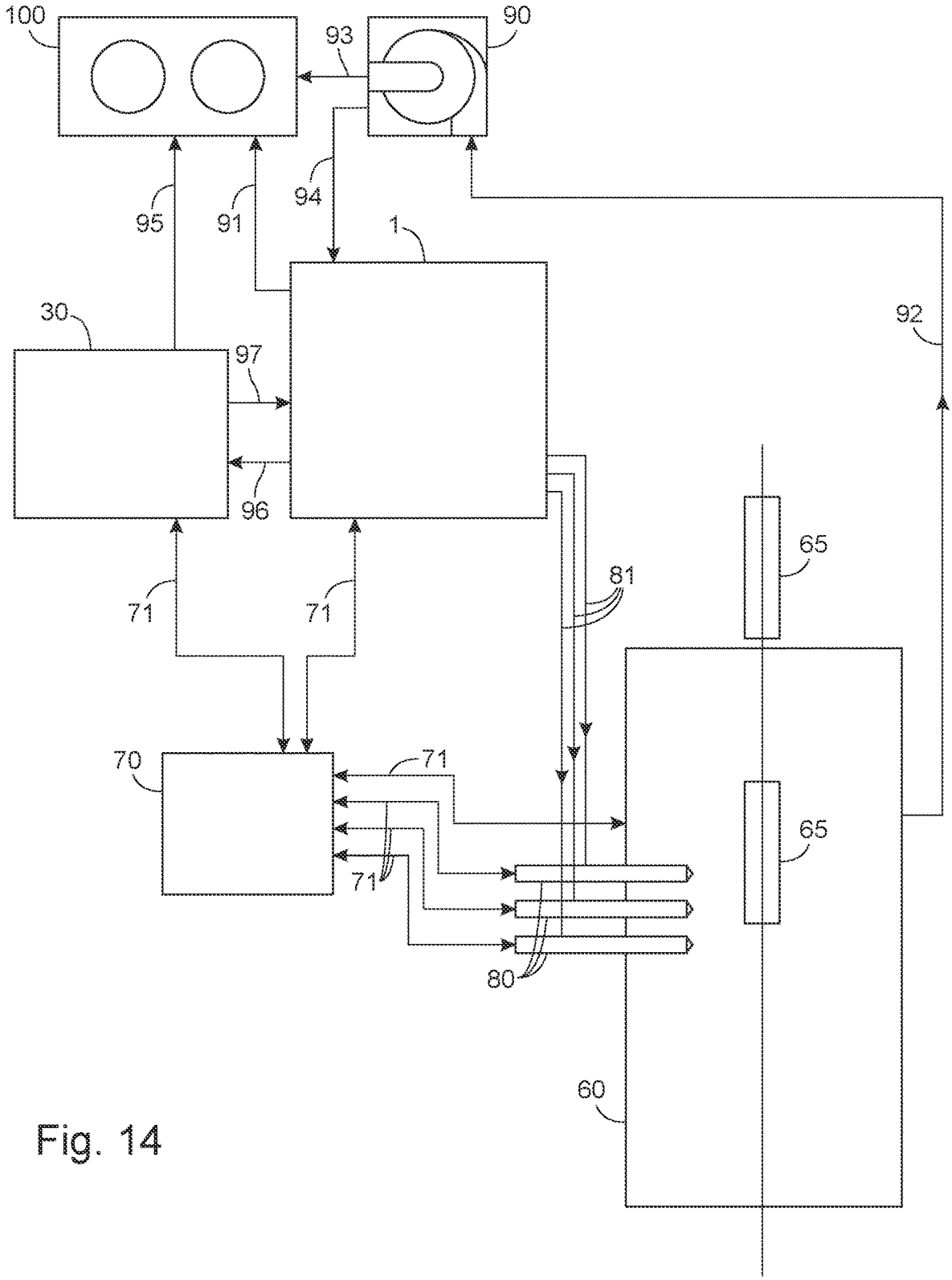
FIG. 14 shows a top view of a possible layout of a powder coating facility including the powder center and the fresh powder station.
Figure 15:
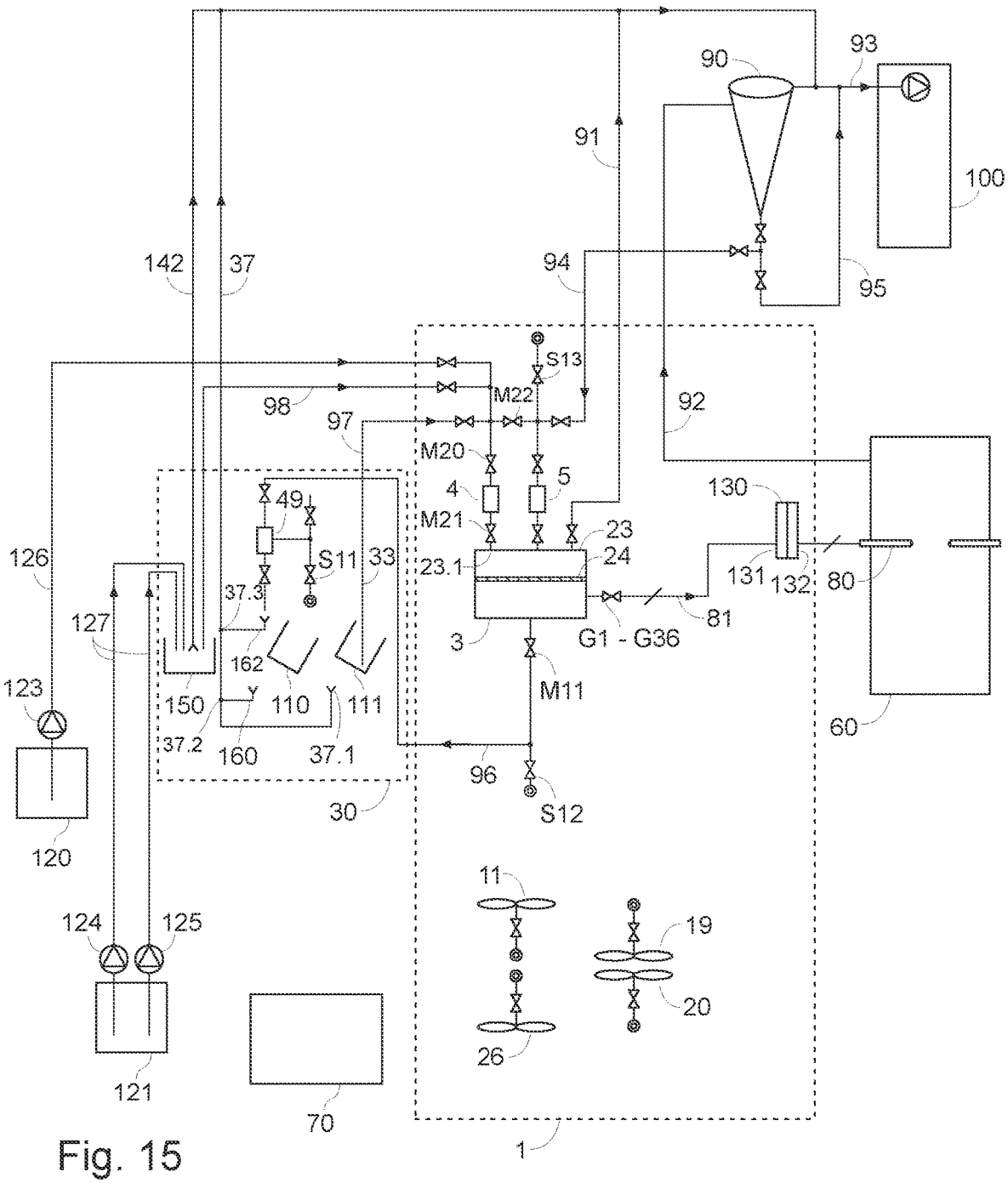
FIG. 15 shows a pneumatics diagram of an embodiment of the powder coating facility including the powder center and the fresh powder station.
Figure 16:
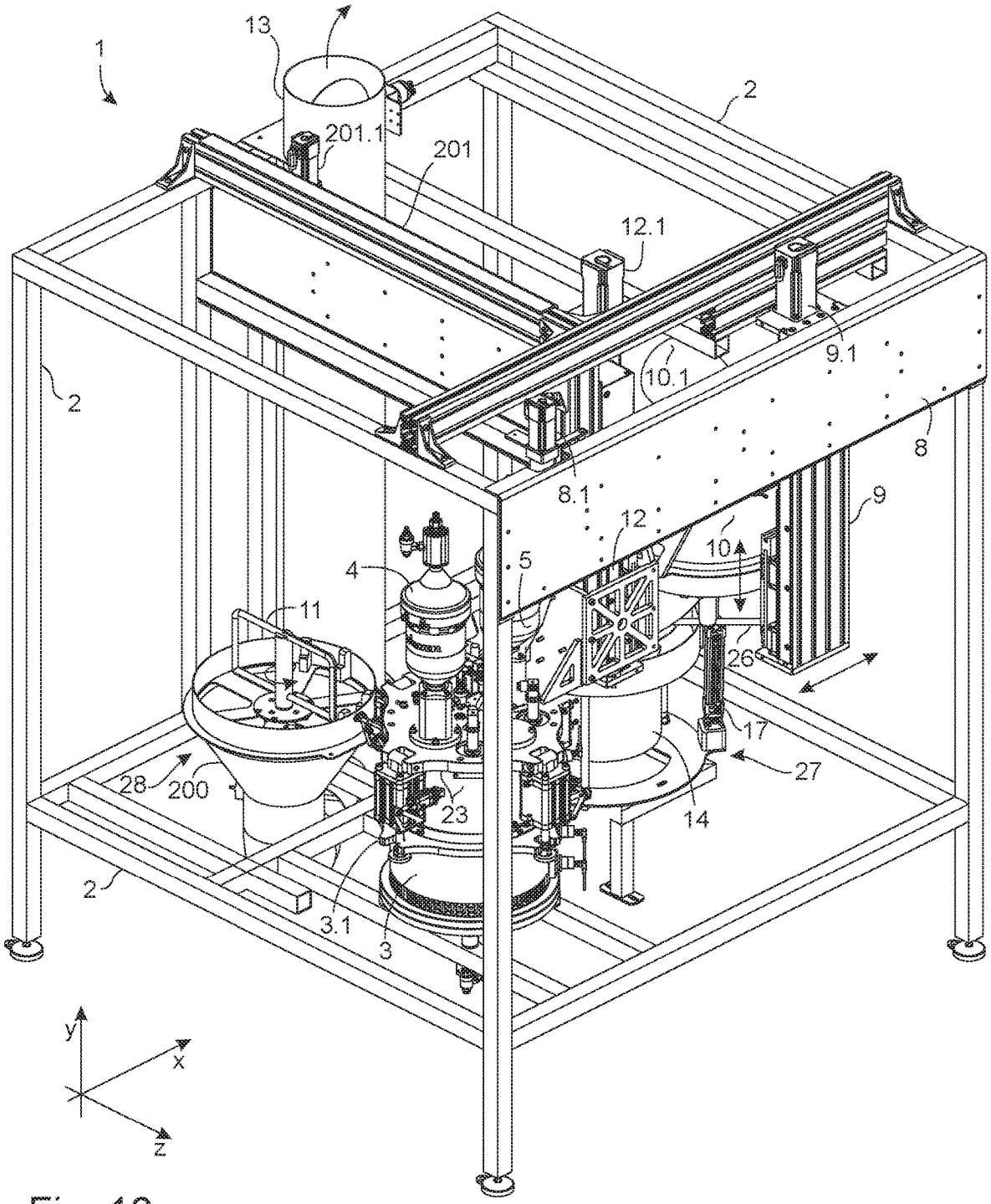
FIG. 16 shows a first three-dimensional view of a second possible embodiment of the powder center according to the invention in powder conveying mode.
Figure 17:
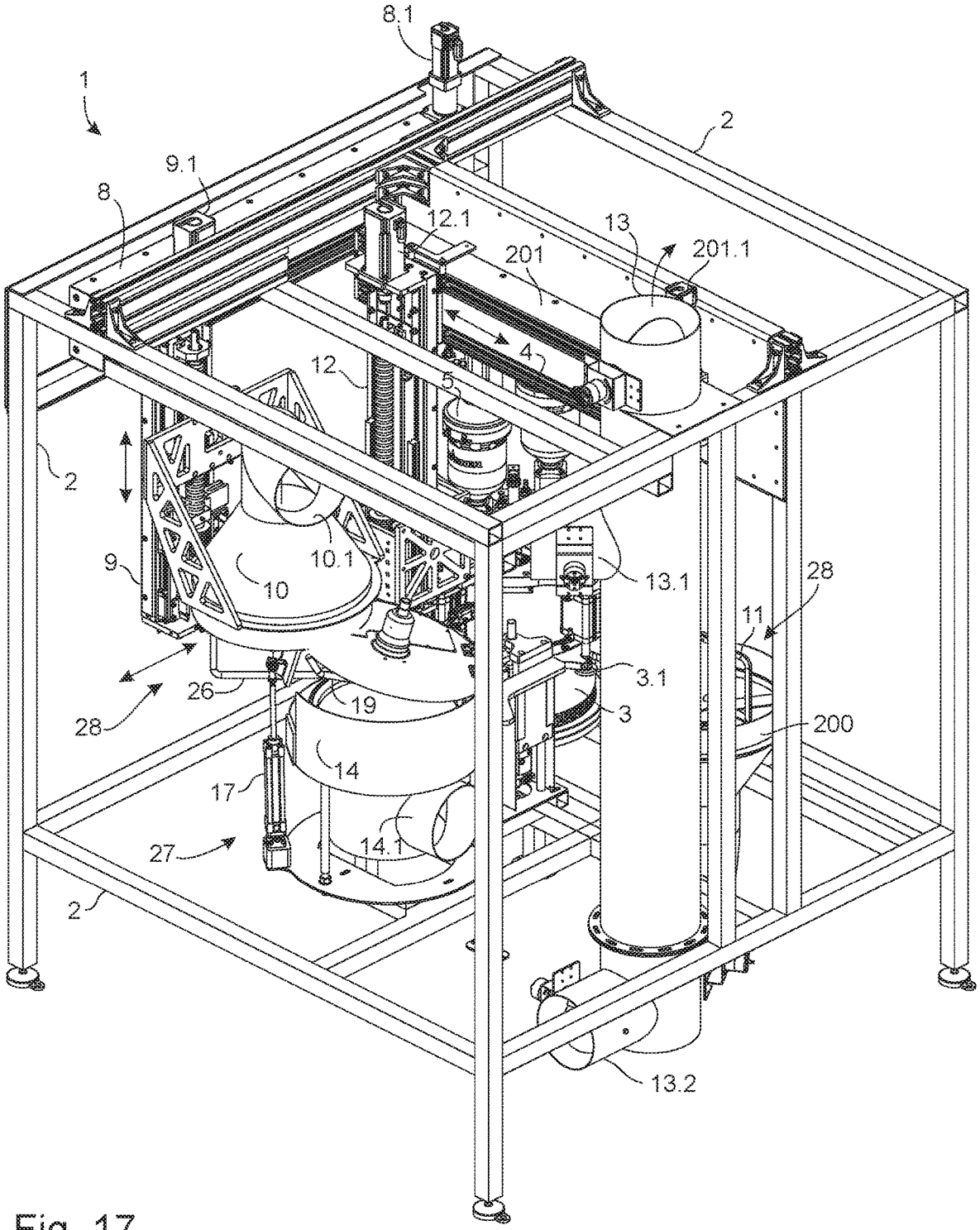
FIG. 17 shows a second three-dimensional view of the second embodiment of the powder center according to the invention.
Figure 18:
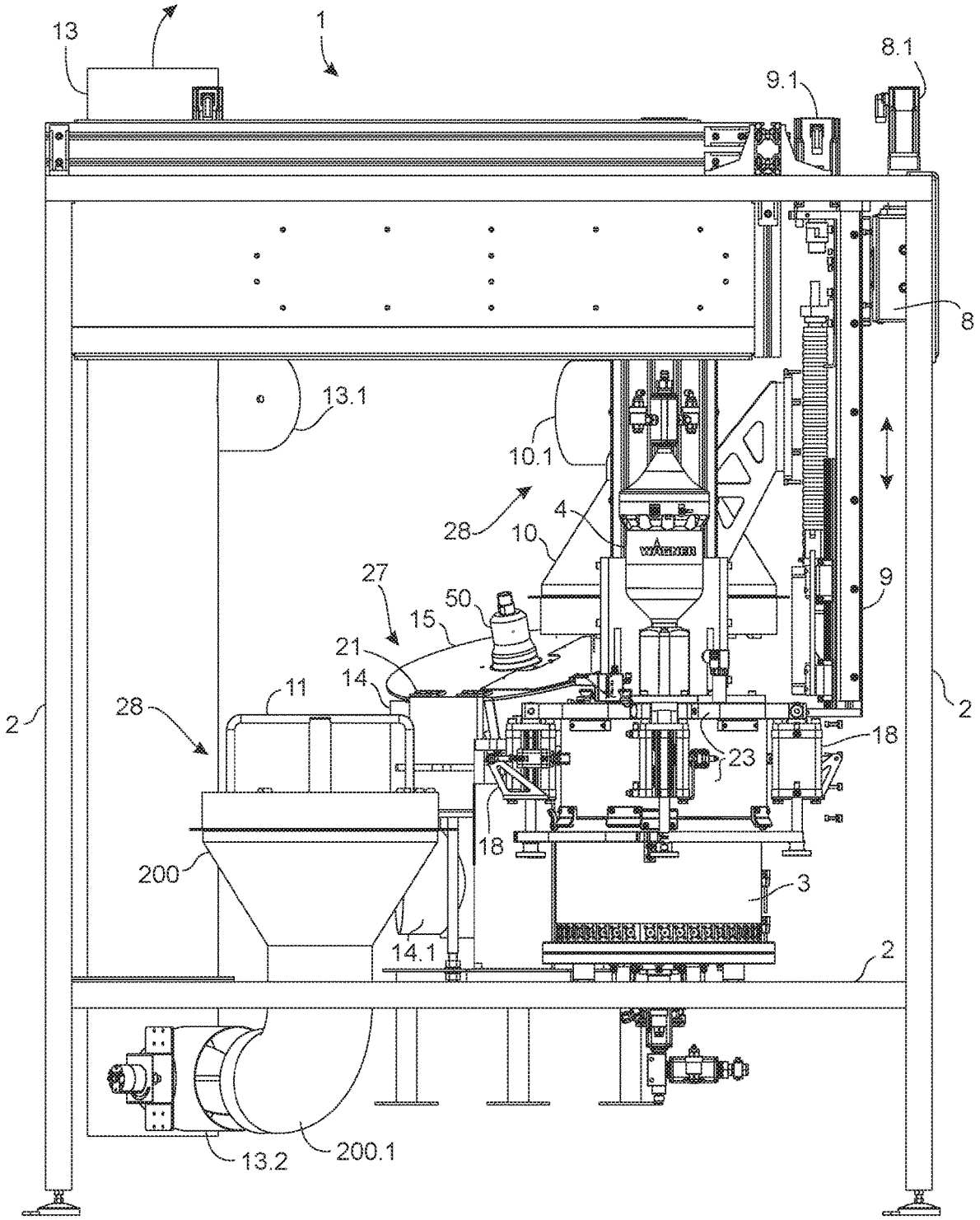
FIG. 18 shows a side view of the second embodiment of the powder center according to the invention.
Figure 19:
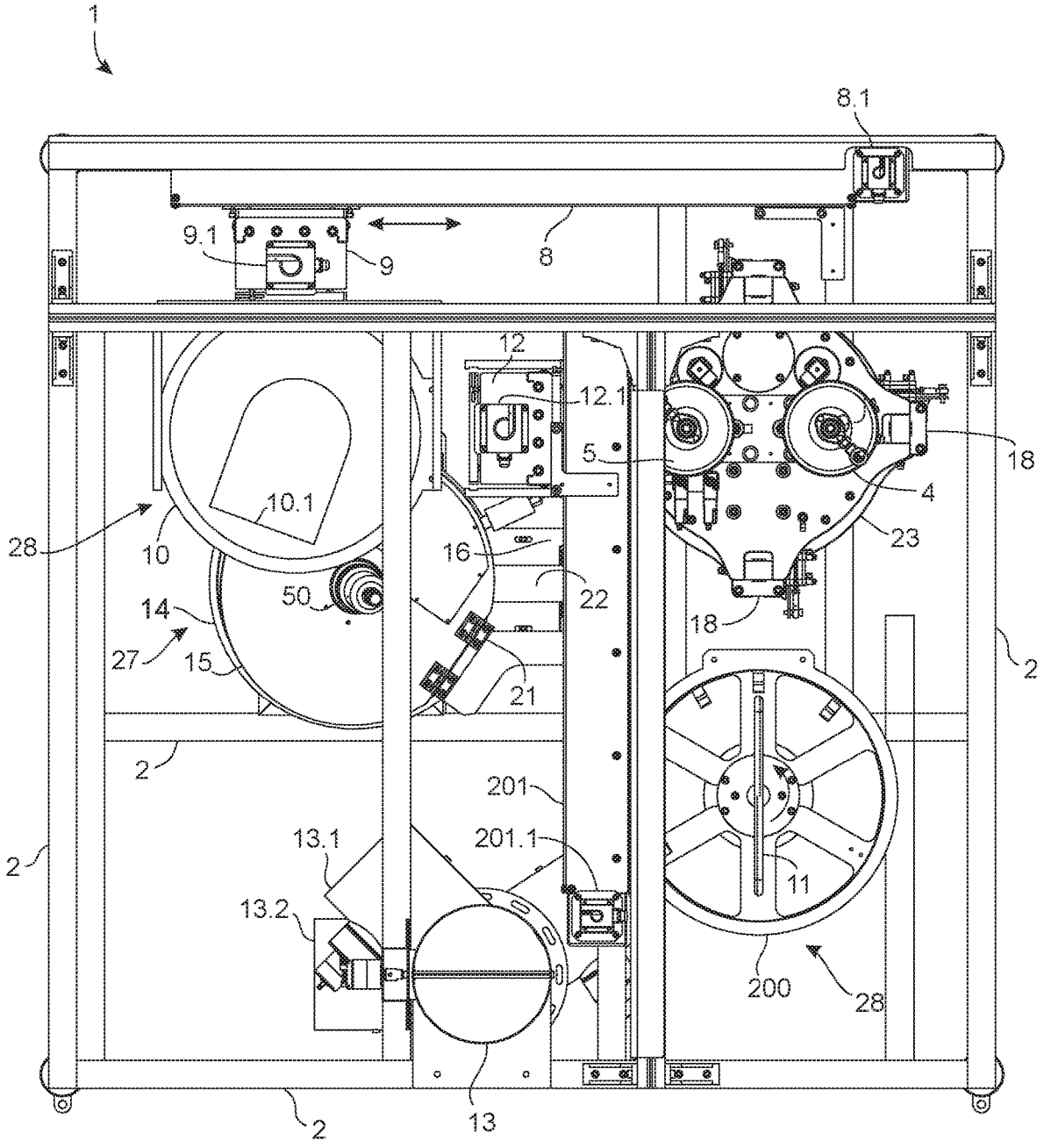
FIG. 19 shows a top view of the second embodiment of the powder center according to the invention.
Figure 20:
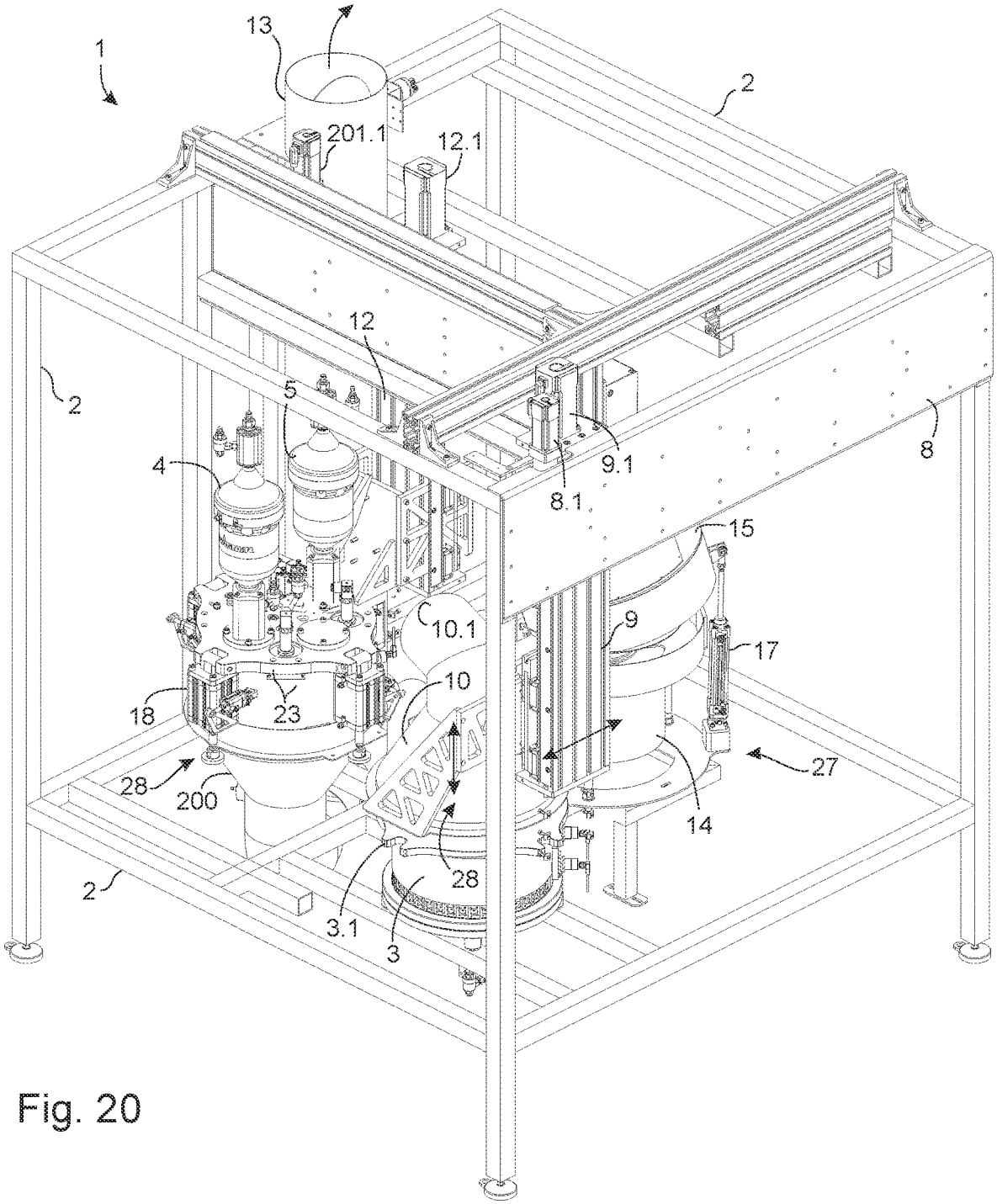
FIG. 20 shows a first three-dimensional view of the second embodiment of the powder center according to the invention in cleaning mode.
Figure 21:
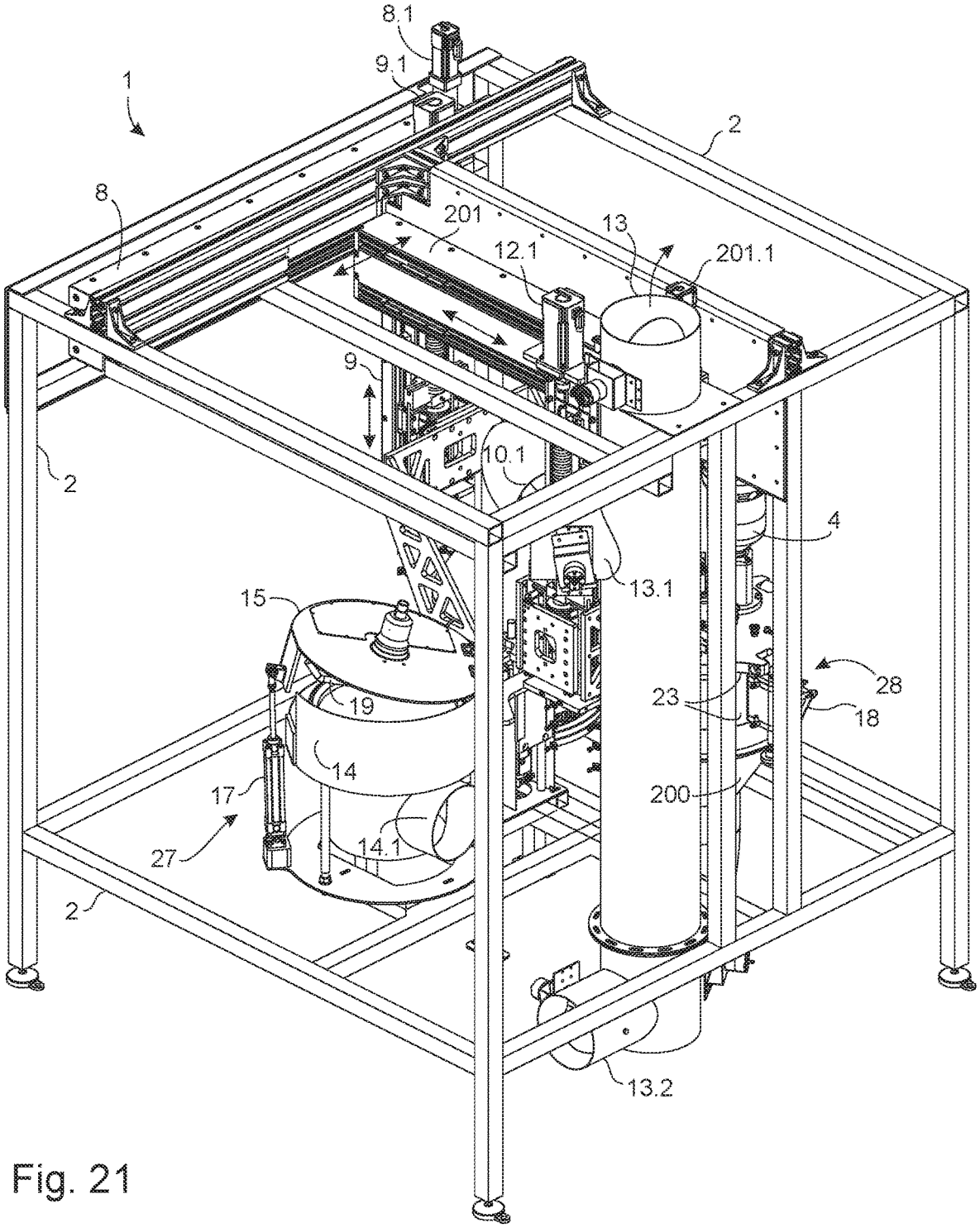
FIG. 21 shows a second three-dimensional view of the second embodiment of the powder center according to the invention in cleaning mode.
Figure 22:
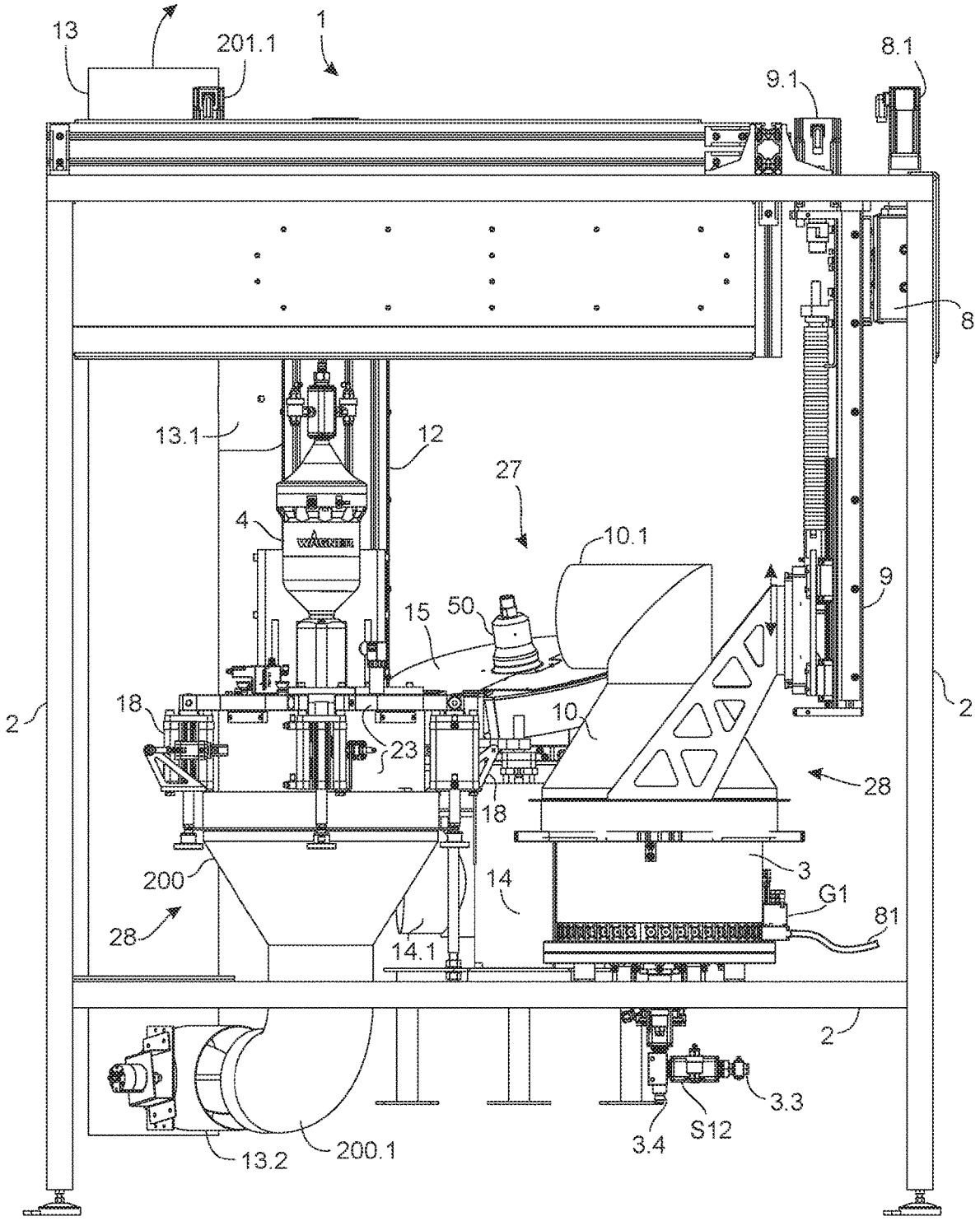
FIG. 22 shows a side view of the second embodiment of the powder center according to the invention in cleaning mode.
Figure 23:
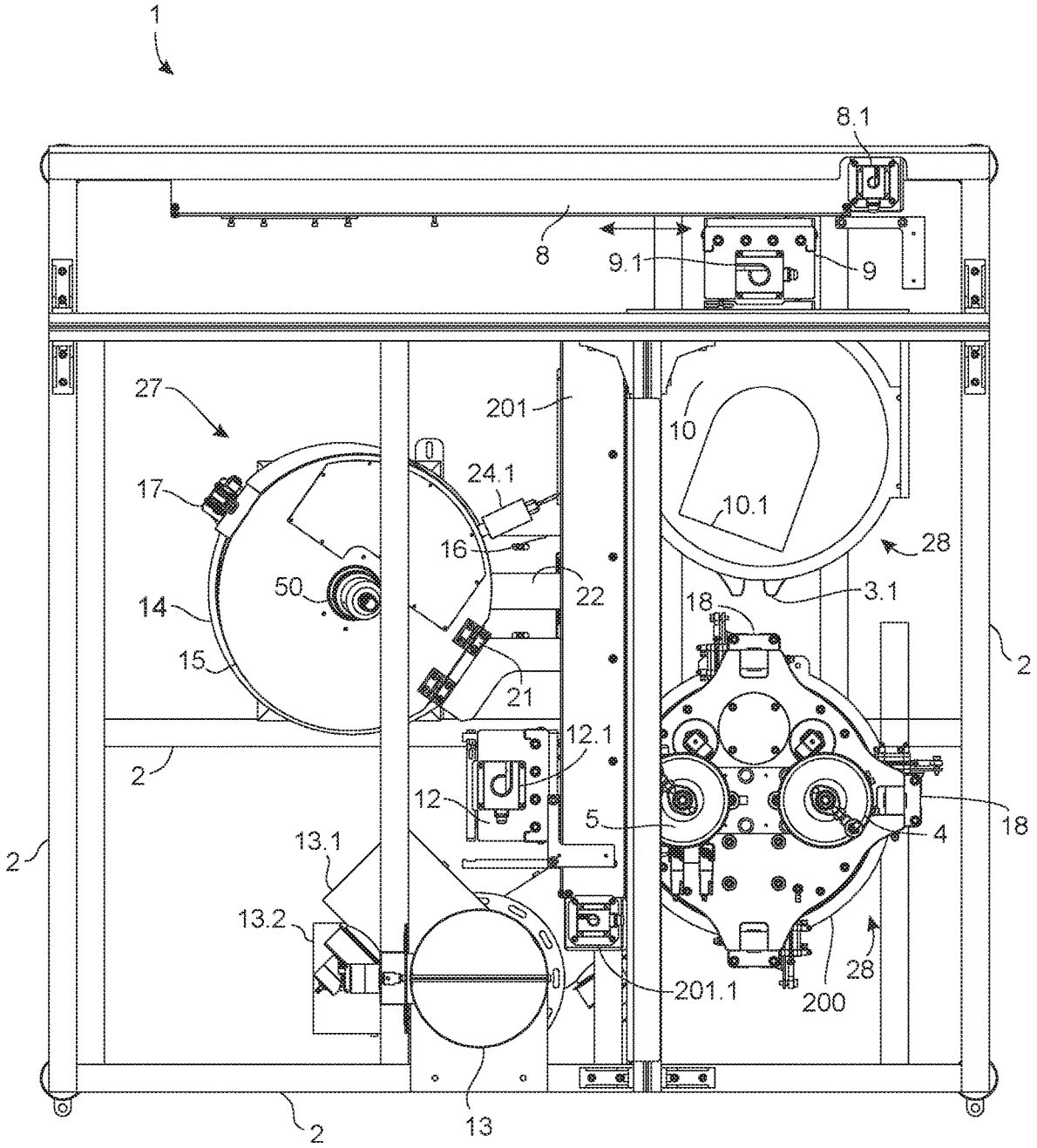
FIG. 23 shows a top view of the second embodiment of the powder center according to the invention in cleaning mode.

One possible embodiment of a total facility for powder coating of workpieces 65 is shown in a top view in simplified manner in FIG. 14. The total facility can be controlled by means of a central controller 70. The controller 70 can be connected via corresponding control lines 71 to various components of the total facility and can be provided for controlling the powder coating cabin 60 including powder applicators 80, the fresh powder station 30, the powder center 1, the powder recycling 90, and the after-filter 100.

Alternatively or in addition to the central controller 70, the fresh powder station 30 can comprise a separate controller 43, as has been mentioned above. The same applies analogously to all other components of the total facility for the coating of workpieces with powder.

Since all powder particles sprayed by the powder applicators 80 do not adhere to the workpieces 65 to be coated during the coating process, the excess powder, which is also referred to as overspray, needs to be removed from the cabin 60. This is necessary, firstly, because the surrounding area outside of the cabin needs to be kept free of powder dust. Secondly, the explosion hazard increases when a certain powder concentration is exceeded by the powder dust cloud floating in the cabin. This needs to be prevented.

The overspray arising during the coating and the air present in the cabin 60 are suctioned out of the cabin 60 as a powder-air mixture and are fed to a device for powder recovery 90 via a residual powder pipeline 92. The device for powder recovery 90 can be designed, for example, as a cyclone. The powder recovered therein can be fed to the powder center 1 again via a powder line 94 in case of need. In order to also remove, by filtering, the fraction of powder that was not removed, by filtering, in the cyclone 90, the powder-air mixture can be fed from the cyclone via a suction line 93 to the after-filter 100.

The powder-air mixture in the residual powder pipeline 92 is also referred to as residual powder air flow. For aspiration of the overspray out of the cabin 60, the cabin 60 comprises, for example, a suction slit. It connects the inside of the cabin 60 to the residual powder pipeline 92. The suction slit and the suction tube 61 are therefore used to aspirate excess powder from the inside of the cabin as a powder-air mixture and to feed it to a cyclone separator 90, or cyclone for short, that can be designed as a mono-cyclone. The powder-air mixture flows tangentially into the cyclone 90 and flows spirally downward inside the cyclone. In the process, the powder particles are pushed outwards against the outer wall of the cyclone 90 by the centrifugal force that arises during the rotation of the powder-air flow. The powder particles are conveyed downwards in the direction of the powder outlet of the cyclone, and are collected there. The air from which the powder particles have been removed is aspirated via the vertical central tube that is situated in the cyclone 90. Thus cleaned, the air flow is often fed to an after-filter 100 in order to remove, by filtering, even the last residual powder present in the air. The powder recycled in the cyclone 90 can be re-used for coating and can be fed to the powder center 1 via the powder line 94.

Conveying Mode/Conveying Operation

In conveying mode, the ultrasound screen 24 is situated in the working container 3, 23, between the powder reservoir container 3 and the powder container lid 23. The locks 18 make sure that the working container is closed in airtight manner. The screen cleaning device 27 and the container cleaning unit 28 are situated in the parking position, as shown in FIGS. 1 to 4.

The parking position for the container cleaning unit 28 is situated next to the powder reservoir container 3. The term «next to the powder reservoir container» shall also comprise above, below, in front of or behind the powder reservoir container.

The screen 24 is not obligatory for conveying mode. The conveying of powder can also take place without an ultrasound screen or without a screen 24 altogether.

Cleaning Mode/Cleaning Operation

For switching from conveying mode to cleaning mode, the conveying of powder out of the powder reservoir container 3 is stopped and the residual powder that is still present in the powder reservoir container 3 is aspirated using the outlet 25.1. The overpressure that is still prevailing in the working container 3, 23 is reduced to normal pressure and the locks 18 are opened.

Then, the powder container lid 23 is lifted by means of the linear drive 12 and the ultrasound screen 24 is pivoted out of the working position into the cleaning position by means of the pivoting mechanism 16.

Figure 7:
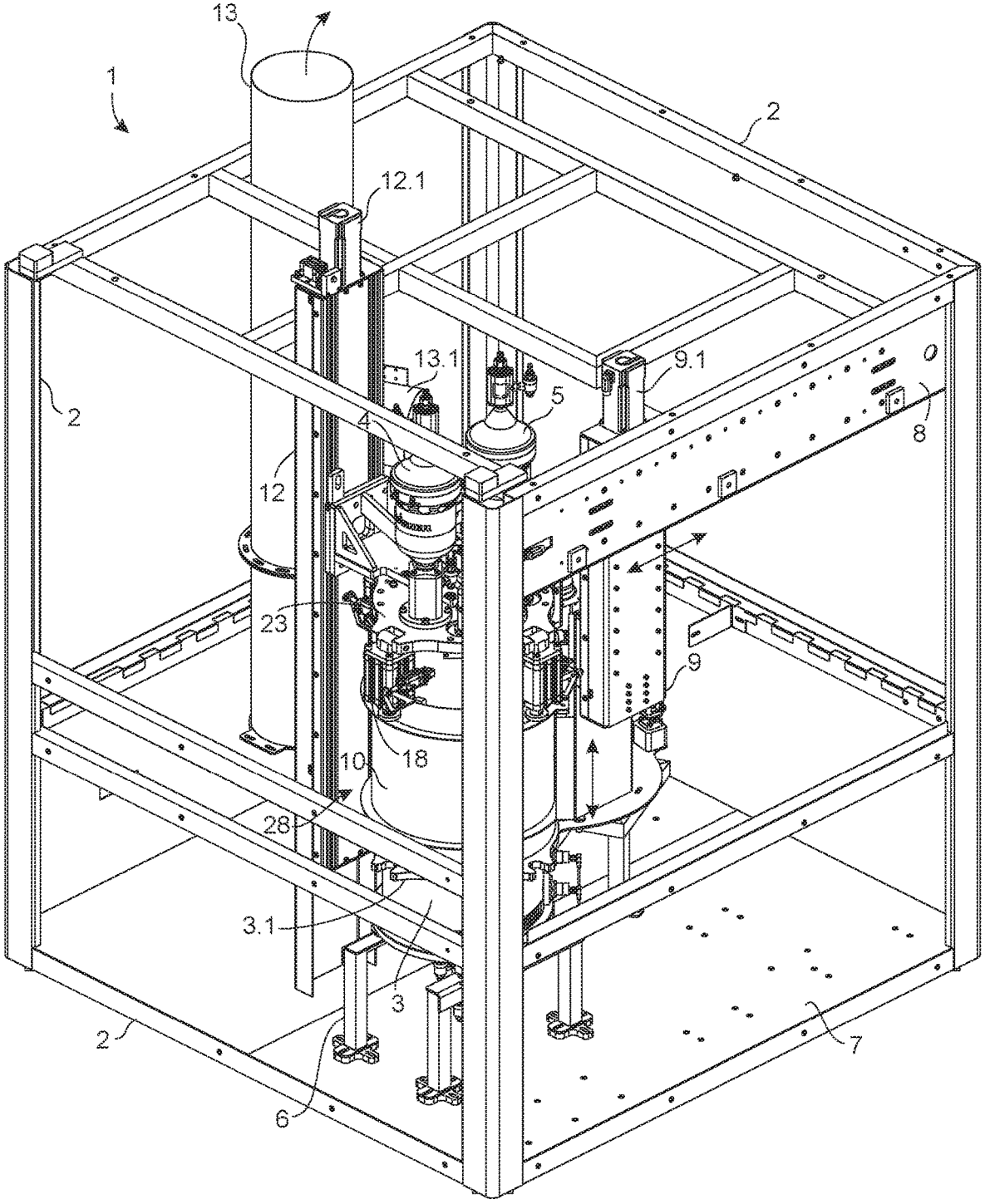
FIG. 7 shows a first three-dimensional view of the first embodiment of the powder center according to the invention in cleaning mode.
Figure 8:
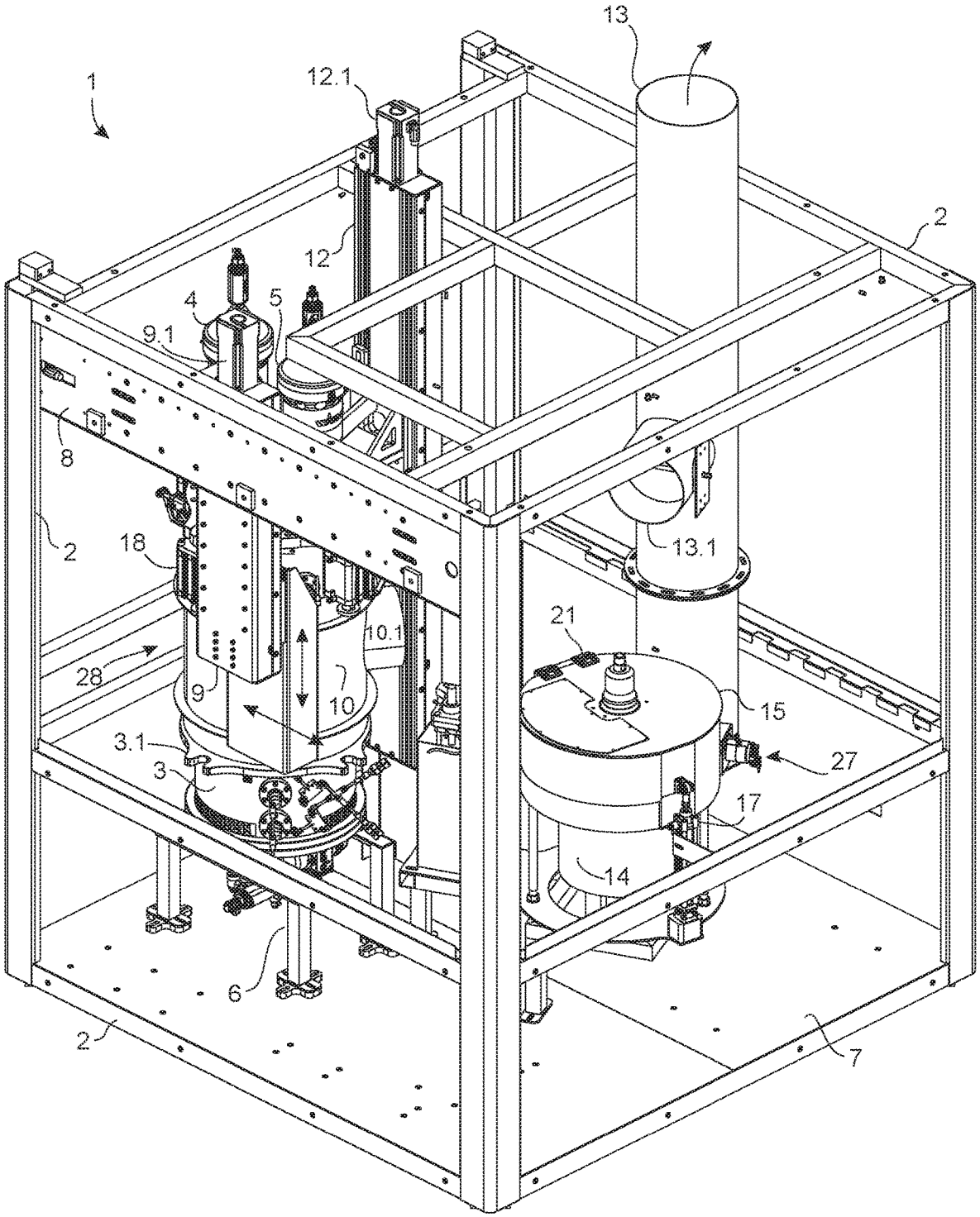
FIG. 8 shows a second three-dimensional view of the first embodiment of the powder center according to the invention in cleaning mode.
Figure 9:
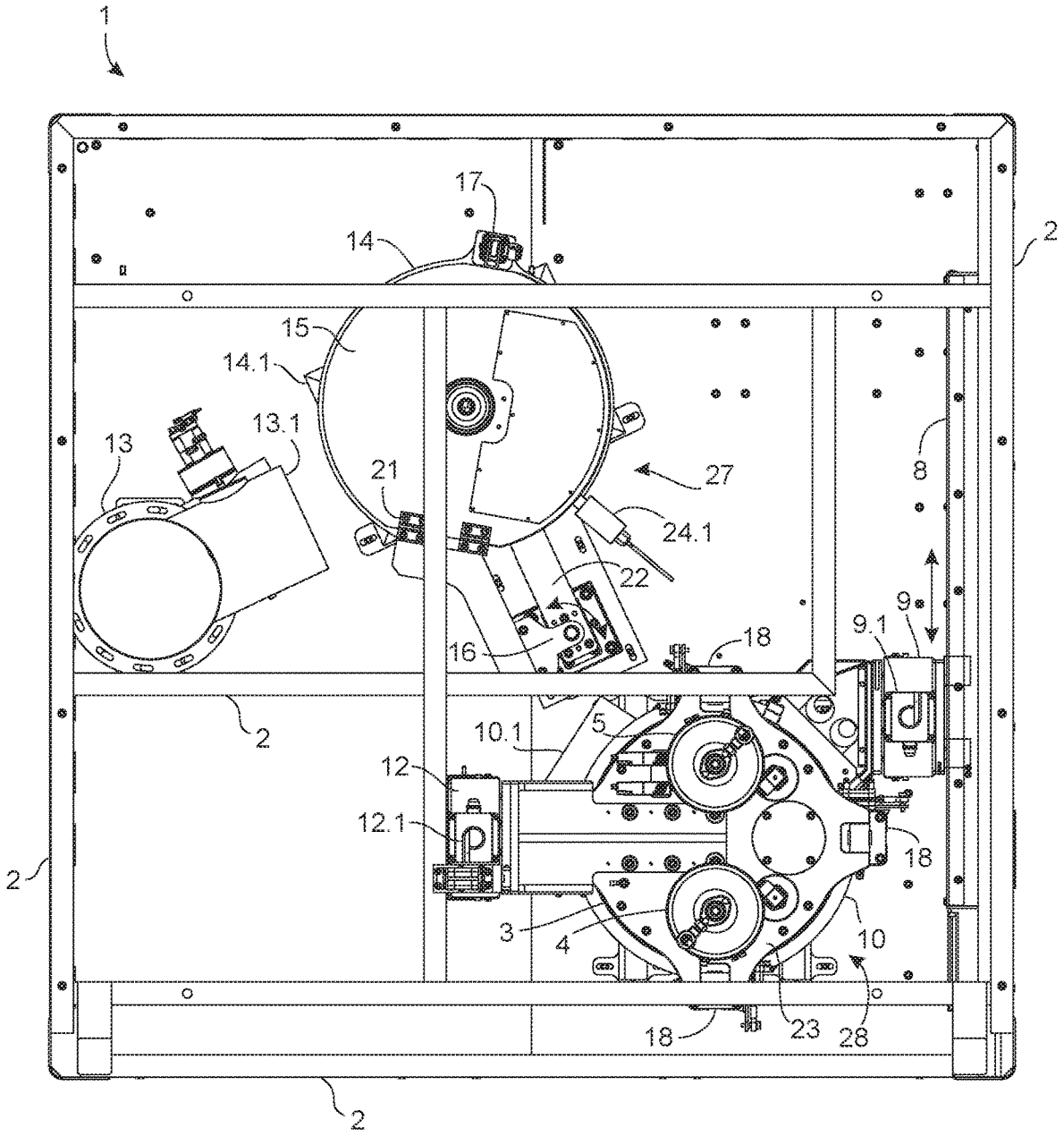
FIG. 9 shows a top view of the first embodiment of the powder center according to the invention in cleaning mode.
Figure 10:
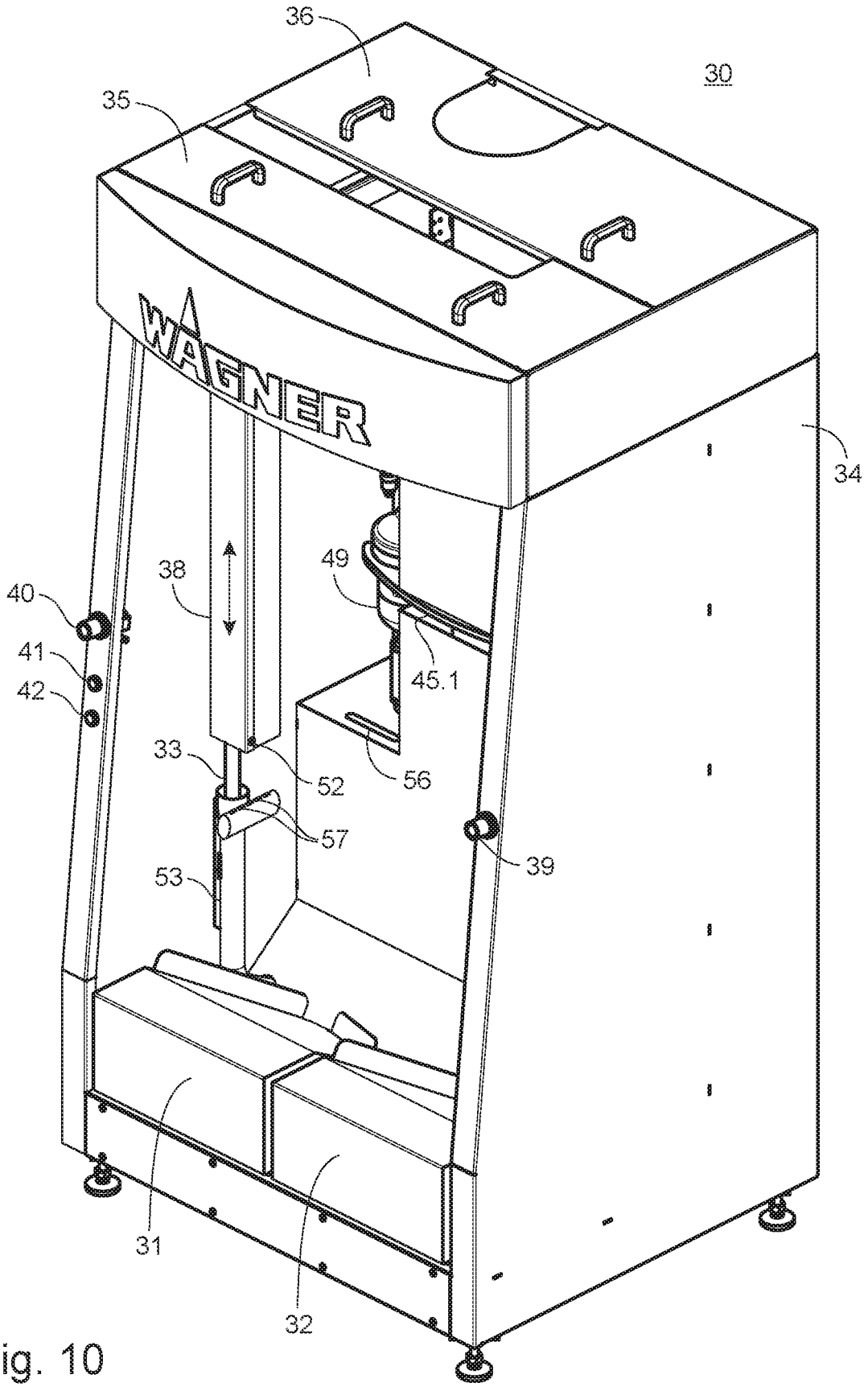
FIG. 10 shows a three-dimensional view of a possible embodiment of a fresh powder station.

As shown in FIGS. 7 to 9, the linear drive 12 lifts the container lid 23 to the extent such that the cleaning container 10 can be driven in between the powder container lid 23 and the powder reservoir container 3 by the two linear axles 8 and 9. Subsequently, the container cleaning unit 28 including the cleaning container 10 is lowered sufficiently until the lower cleaning arm 26 is situated on the inside of the powder reservoir container 3 and is situated at a defined distance from the base 25 of the powder reservoir container 3.

The powder container lid 23 is then lowered to the extent such that the upper cleaning arm 11 is situated on the inside of the powder container lid 23 and is situated at a defined distance from the powder container lid 23.

In the embodiment above, an air gap remains between the powder container lid 23 and the cleaning container 10. Likewise, an air gap remains between the powder container 3 and the cleaning container 10. The after-filter 100 aspirates air through the air gap. This prevents the powder-air mixture generated by the compressed air nozzles 11.1 and 26.1 during the cleaning process from escaping into the surroundings.

Instead, it is feasible just as well to lower the powder container lid 23 to the extent such that no gap remains between the powder container lid 23 and the cleaning container 10. Likewise, the gap between the cleaning container 10 and the powder container 3 can be eliminated by lowering the cleaning container 10 to the extent such that it is placed on top of the powder container 3.

In another embodiment, the locks 18 can close the unit made up of powder container lid 23, cleaning container 10, and powder reservoir container 3, in airtight manner.

In a next step, compressed air is blown through the nozzles 11.1 and 26.1 in the direction of the inner walls of the powder container lid 23 and of the powder reservoir container 3. The powder-air mixture thus generated is aspirated via the suction line 13 and can be fed to the cyclone 90 and/or to the after-filter 100.

As soon as the screen 24 and/or the ultrasound screen is situated in the cleaning container 14, the lid 15 is closed by means of the pneumatic cylinder 17. An air gap can remain between the lid 15 and the cleaning container 14. In another embodiment, the lid 15 can just as well be placed on the cleaning container 14 in airtight manner.

Now, compressed air is being blown through the nozzles 19.1 and 20.1 from above and below onto the screen 24. The powder-air mixture thus generated is aspirated via the suction line 13 and can be fed to the cyclone 90 and/or to the after-filter 100.

As soon as the screen 24 is clean, the blowing off of the screen is terminated. Once the powder container 3 and the container lid 23 are clean, the blowing off is terminated here as well.

If the locks 18 had previously been closed, they are now being opened again. The container lid 23 is being lifted and the container cleaning unit 28 is being moved back into the parking position (see FIGS. 1-4). The lid 15 is being lifted as well. Once the cleaning mode is completed, the screen 24 is driven back into its working position. Subsequently, the conveying of powder can be started again.

Cleaning Mode with Intensive Cleaning

The following cleaning steps can be carried out in order to clean the powder center 1 and the other components of the facility contacting the coating powder even more thoroughly. The steps are preferably carried out automatically and are coordinated by the controller 70. The cleaning unit 28 is used to clean the powder reservoir container 3 and the container lid 23, as described above. In a further step, a switch to a different coating powder is carried out. The other coating powder in this context can be the powder that is the next to be used for coating the workpieces 65. But this does not necessarily have to be the case. Instead, a switch to a special cleaning agent can be carried out just as well. The cleaning agent can be, for example, a granulate with a grain size between 2 mm and 7 mm. The grain size, the grain material, and the grain properties are preferably selected appropriately such that, firstly, the cleaning agent can be conveyed through all openings in the powder system and, secondly, has a good cleaning effect. The selection of the cleaning agent advantageously takes into consideration that no additional wear and tear in the powder system and no chemical incompatibility with the coating powder arises.

In an additional step, a switch to conveying mode is effected for a limited period of time such that the other coating powder and/or the cleaning agent flows through the individual components of the facility. During the brief conveying mode, for example 3 kg of powder that are ultimately lost can be conveyed. But it is also feasible to recover the material (the powder and/or the cleaning agent) in the cyclone 90. As a result, the powder lines 91, 92, 93, and 94 can also be purged with the new material. This is of advantage, in particular, if the new powder is conveyed to be recovered.

Subsequently, the powder reservoir container 3 and the container lid 23 are cleaned again by means of the cleaning unit 28.

The cleaning parameters, such as, for example, number and duration of the compressed air pulses for blowing off the screen 24, number and duration of the compressed air pulses for blowing off the container lid 23, number and duration of the compressed air pulses for blowing off the powder container 3 as well as the air pressure used for the compressed air pulses can be defined by the controller 70 and can be changed as well. The controller 70 can define the cleaning parameters required for optimal cleaning autonomously. In this context, it can take into consideration the type of powder and its color. It is also possible to feed to the controller 70 external information that is helpful for the definition of the cleaning parameters. Accordingly, for example, a barcode or RFID tag attached to the powder carton 110 or the Big Bag 120 can be read. The information obtained from the barcode or RFID tag can be analyzed by the controller 70 for adjustment of the cleaning parameters.

A second embodiment of the powder center 1 is shown in FIGS. 16 to 23. The second embodiment differs from the first embodiment with regard to the container cleaning unit 28. The container cleaning unit 28 of the second embodiment comprises a first station for cleaning the powder container lid 23 and a second station for cleaning the powder reservoir container 3.

The first station can comprise a funnel-shaped container 200 that bears the lower cleaning arm 11. During conveying mode (see FIGS. 16 to 19), the container lid 23 is situated on the powder reservoir container 3.

When a switch to cleaning mode is made (see FIGS. 20 to 23), the container lid 23 is lifted by the linear drive 12 and is transported by another linear drive 201 from the powder reservoir container 3 to the lid cleaning station. Subsequently, the container lid 23 is lowered onto the funnel-shaped container 200 by the linear drive 12 until the cleaning arm 11 is situated at a defined distance from the container lid 23.

The second station with the cleaning container 10 can be designed identical to the first embodiment. At the onset of cleaning mode, the cleaning container 10 of the cleaning station 28 is lifted by the linear drive 9 and is positioned above the powder reservoir container 3 by the linear drive 8. Subsequently, the cleaning container 10 above the powder container 3 is lowered appropriately until the cleaning arm 26 is situated at a defined distance from the base 25 of the powder reservoir container 3.

The preceding description of exemplary embodiments according to the present invention serves for illustrative purposes only. Various changes and modifications are feasible within the scope of the invention. Accordingly, for example, the powder center 1 shown in FIGS. 1 to 9 can be expanded to include the fresh powder station 30 shown in FIGS. 10 to 13. A powder center expanded to include the fresh powder station 30 shall also be referred to as expanded powder center hereinafter.

The individual components of the powder center 1 can be combined with each other and can be arranged in ways differing from the one shown in FIGS. 1 to 13.

Likewise, the arrangement of the powder center 1, fresh powder station 30, powder coating facility 60, controller 70, cyclone 90, and after-filter 100 is not limited to the arrangement shown in FIG. 14. The facility may just as well be supplemented by some component.

In as far as reference is made to taking off or partially taking off the container lid 23, the container lid 23 being flipped back shall be included as well. Accordingly, the container lid 23 does not need to be completely separated from the container 3 for cleaning. The cleaning unit 28 can be designed appropriately such that it can be moved in between the container 3 and the flipped open container lid 23 in order to clean the container 3 and the container lid 23 from this location.

LIST OF REFERENCE NUMBERS

1 Powder center
2 Frame profiles
3 Powder reservoir container
3.1 Lock receptacle
3.2 Outlet opening for powder
3.3 Compressed air connector for purging air
3.4 Powder outlet
4 Powder conveyor
4.2 Powder outlet
5 Powder conveyor
6 Pedestal
7 Base sheet
8 Linear drive
8.1 Drive motor
9 Linear drive
9.1 Drive motor
10 Cleaning container
10.1 Outlet
11 Cleaning arm for the lid
11.1 Cleaning nozzles
12 Linear drive
12.1 Drive motor
13 Suction line/suction tube
13.1 Inlet opening
13.2 Inlet opening
14 Screen cleaning container
14.1 Outlet
14.2 Lower container section
15 Lid of the screen cleaning device
16 Pivoting mechanism
17 Lifting cylinder
18 Lock
19 Cleaning arm
19.1 Screen cleaning nozzles
20 Cleaning arm
20.1 Screen cleaning nozzles
21 Hinge
22 Support arm for the powder screen
23 Container lid
23.1 Powder inlet
24 Ultrasound screen
24.1 Ultrasound transducer
25 Container base
25.1 Fluidizing insert
25.2 Outlet
26 Cleaning arm for the powder reservoir container
26.1 Cleaning nozzles
27 Screen cleaning device
28 Cleaning unit/container cleaning unit
30 Fresh powder station

31 First storage space
32 Second storage space
33 Suction lance
34 Side wall
35 Lid
36 Lid
37 Suction system
37.1 Suction opening
37.2 Suction opening
37.3 Suction opening
38 Linear axle for the suction lance
39 Compressed air regulating valve
40 Compressed air regulating valve
41 Adjusting knob
42 Adjusting knob
43 Controller
44 Linear drive
45 Pivoting mechanism for powder conveyor
45.1 Arm
46 Scale
47 Scale
48 Rear wall
49 Powder conveyor
50 Bearing
51 Bearing
52 Cleaning station
53 Cleaning station
54 Vibrator
55 Vibrator
56 Compressed air nozzle
57 Compressed air nozzle
30 Powder coating cabin
65 Workpiece
70 Controller
71 Control line
80 Powder spray gun
81 Powder line
90 Powder recovery
91 Suction line
92 Suction line
93 Suction line
94 Powder line
95 Suction line
96 Powder return line
97 Powder line
98 Powder line
100 After-filter
110 Powder carton
111 Powder carton
120 Big Bag
121 Big Bag
123 Powder pump
124 Powder pump
125 Powder pump
126 Powder line
127 Powder line
130 Coupling
131 First group of connectors
132 Second group of connectors
141 Residual powder line
142 Residual powder line
150 Intermediate container for powder
160 Suction opening
162 Suction opening
200 Cleaning container
200.1 Outlet opening on cleaning container
201 Linear drive
201.1 Drive motor
220 Vibrator
M11 Valve for powder material
M21 Valve for powder material
S11 Purging valve
S12 Purging valve
G1-G36 Outlet valves
x x-axis
y y-axis
z z-axis

The invention claimed is:

1. A powder center for supplying a powder coating facility with coating powder comprises:

a powder reservoir container with a powder conveyor for transporting powder out of the powder reservoir container in the direction of the powder coating facility;

a container lid that covers the powder reservoir container while powder is being conveyed and can be removed at least partly for the purpose of cleaning the powder reservoir container, a cleaning unit for cleaning the powder reservoir container and the container lid that can be moved from a parking position next to the powder reservoir container into a cleaning position inside the powder reservoir container by a manipulator, wherein the powder reservoir container extends along a longitudinal axis and has an opening that encompasses the longitudinal axis, in which the opening is coverable by the container lid, wherein the cleaning unit is configured to be laterally offset from the longitudinal axis of the powder reservoir container when in the parking position, wherein the cleaning unit is configured to clean an inside of the container lid and inside the powder reservoir container when in the cleaning position, and a controller by which the powder conveyor, the cleaning unit, and the manipulator can be controlled.

2. The powder center according to claim 1, wherein the cleaning unit comprises compressed air nozzles for blowing off the powder reservoir container and the container lid.

3. The powder center according to claim 2, wherein a portion of the compressed air nozzles is arranged on a first cleaning arm and another portion of the compressed air nozzles is arranged on a second cleaning arm, and wherein the first cleaning arm is used for cleaning the lid and the second cleaning arm is used for cleaning the powder reservoir container.

4. The powder center according to claim 3, wherein the first cleaning arm and the second cleaning arm are supported such that they can be rotated.

5. The powder center according to claim 3, wherein the first cleaning arm and/or the second cleaning arm comprise a brush and/or a suction facility.

6. The powder center according to claim 3, wherein the cleaning unit comprises a cleaning container that bears the first cleaning arm and/or the second cleaning arm, and positions the cleaning arm in the powder reservoir container in cleaning mode.

7. The powder center according to claim 1, wherein the manipulator comprises a linear axle for moving the cleaning unit.

8. The powder center according to claim 1, wherein the manipulator is a robot.

9. A powder center for supplying a powder coating facility with coating powder comprises:

a powder reservoir container with a powder conveyor for transporting powder out of the powder reservoir container in the direction of the powder coating facility;

a container lid that covers the powder reservoir container while powder is being conveyed and can be removed at least partly for the purpose of cleaning the powder reservoir container, a cleaning unit for cleaning the powder reservoir container and the container lid that can be moved from a parking position next to the powder reservoir container into a cleaning position inside the powder reservoir container by a manipulator, a controller by which the powder conveyor, the cleaning unit, and the manipulator can be controlled, wherein multiple powder conveyors are provided, wherein a coupling with a first group of connectors and a second group of connectors is provided, whereby the controller can be used to set which connector of the first group is connected to which connector of the second group, wherein the powder conveyors are connected, on the outlet side, to one of the connectors of the first group each.

10. The powder center according to claim 1, wherein another powder conveyor, by which the coating powder can be conveyed into the powder reservoir container, is arranged above the container lid.

11. The powder center according to claim 1, wherein a powder outlet for residual powder is provided in the base of the powder reservoir container, wherein a further powder conveyor allows the residual powder to be suctioned through the powder outlet out of the powder reservoir container and to be fed to a powder container.

12. The powder center according to claim 1, wherein a further manipulator is provided in order to be able to take the container lid off the powder reservoir container.

13. A powder center for supplying a powder coating facility with coating powder comprises:

a powder reservoir container with a powder conveyor for transporting powder out of the powder reservoir container in the direction of the powder coating facility;

a container lid that covers the powder reservoir container while powder is being conveyed and can be removed at least partly for the purpose of cleaning the powder reservoir container, a cleaning unit for cleaning the powder reservoir container and the container lid that can be moved from a parking position next to the powder reservoir container into a cleaning position inside the powder reservoir container by a manipulator, a controller by which the powder conveyor, the cleaning unit, and the manipulator can be controlled, wherein the cleaning unit comprises a container lid cleaning device for cleaning the container lid, whereby the container lid cleaning device bears a first cleaning arm.

14. The powder center according to claim 1, wherein the powder reservoir container has a circular cross-section.

15. The powder center according to claim 1, wherein a screen and a screen cleaning device for cleaning the screen are provided, wherein the screen, for the purpose of cleaning, can be moved from a working position in the powder reservoir container into a cleaning position in the screen cleaning device by an additional manipulator.

16. The powder center according to claim 15, wherein the screen cleaning device comprises an upper cleaning arm with compressed air nozzles and a lower cleaning arm with compressed air nozzles, and wherein the screen is situated in between the up-per cleaning arm and the lower cleaning arm during the cleaning.

17. The powder center according to claim 15, wherein the screen cleaning device comprises a cleaning container with a lid that can be opened, wherein an upper cleaning arm is supported on the lid such that it can be rotated, and wherein a lower cleaning arm is supported on the cleaning container such that it can be rotated.

18. The powder center according to claim 1, wherein a suction system for aspirating the powder-air mixture generated by the cleaning unit is provided.

19. A method for cleaning a powder center, comprising:

providing the powder center according to claim 1, wherein the cleaning unit is used to clean the powder reservoir container and the container lid, wherein a switch to a different coating powder or a cleaning agent is made, wherein a switch to conveying mode is made for a limited period of time, and wherein the cleaning unit is subsequently used to again clean the powder reservoir container and the container lid.

* * * * *